US006705696B1

(12) United States Patent
Okuda et al.

(10) Patent No.: US 6,705,696 B1
(45) Date of Patent: Mar. 16, 2004

(54) METHOD OF DRIVING INKJET RECORDING HEAD AND INKJET RECORDING APPARATUS

(75) Inventors: Masakazu Okuda, Tokyo (JP); Masatoshi Araki, Tokyo (JP)

(73) Assignee: Fuji Xerox Co., Ltd (JP)

( * ) Notice: Subject to any disclaimer, the term of this patent is extended or adjusted under 35 U.S.C. 154(b) by 0 days.

(21) Appl. No.: 09/890,336

(22) PCT Filed: Jan. 26, 2000

(86) PCT No.: PCT/JP00/00389

§ 371 (c)(1),
(2), (4) Date: Jul. 27, 2001

(87) PCT Pub. No.: WO00/44564

PCT Pub. Date: Aug. 3, 2000

(30) Foreign Application Priority Data

Jan. 28, 1999 (JP) ..... 11-020613

(51) Int. Cl.[7] ..... B41J 29/38
(52) U.S. Cl. ..... 347/11; 347/10; 347/68
(58) Field of Search ..... 347/20, 68, 10, 347/11, 5, 9

(56) References Cited

U.S. PATENT DOCUMENTS 6,161,912 A * 12/2000 Kitahara et al. ..... 347/9

FOREIGN PATENT DOCUMENTS

| | | | |
|---|---|---|---|
| EP | 0608835 | A2 * | 3/1994 |
| EP | 0827838 | | 3/1998 |
| EP | 08864425 | A1 * | 9/1998 |
| EP | 0947325 | A1 * | 6/1999 |
| EP | 0963845 | A1 * | 12/1999 |
| JP | 5-69542 | | 3/1993 |
| JP | 6-188475 | | 7/1994 |
| JP | 9-52360 | | 2/1997 |
| JP | 9-141851 | | 6/1997 |
| JP | 10-146970 | | 6/1998 |
| JP | 2000-71444 | | 3/2000 |

* cited by examiner

*Primary Examiner*—Hai Pham
*Assistant Examiner*—Lam Nguyen
(74) *Attorney, Agent, or Firm*—Dickstein, Shapiro, Morin & Oshinsky, LLP.

(57) ABSTRACT

A method of driving an inkjet recording head designed to eject an ink droplet (67) via an ink nozzle (62) communicated to a pressure chamber filled with ink by generating a pressure wave in the pressure chamber by applying a driving voltage to a piezoelectric actuator of the inkjet recording head. The driving voltage waveform has a voltage rise portion (11) for contracting a volume of the pressure chamber (61) and a voltage fall portion (12) for expanding the volume of the pressure chamber. A rise time t1 of the voltage rise portion (11) and a voltage fall time t2 of the voltage fall portion 12 are set smaller than an inherent vibration period Ta of the piezoelectric actuator. An ink droplet having a smaller diameter can be produced, thereby improving the printing precision.

36 Claims, 24 Drawing Sheets

METHOD OF DRIVING INKJET RECORDING HEAD AND INKJET RECORDING APPARATUS

TECHNICAL FIELD

The present invention relates to a method of driving an inkjet recording head and an inkjet recording apparatus, and specifically, to a driving technique for driving an inkjet recording head for the recording of characters and images by the ejection of minute ink droplets from an ink nozzle in an inkjet recording apparatus.

BACKGROUND ART

As a conventional inkjet recording system, a drop-on-demand type inkjet system is known whereby an electromechanical transducer such as a piezoelectric actuator is used to cause a pressure wave (acoustic wave) to be generated in a pressure chamber filled with a liquid ink, so that the pressure wave ejects an ink droplet from a nozzle coupled with the pressure chamber. Such inkjet recording method using the drop-on-demand type inkjet system is disclosed in Japanese Patent Publication No. Sho. 53-12138, for example. An example of the structure of the inkjet recording head of this type is shown in FIG. 22.

Referring to FIG. 22, a pressure chamber 61 is connected with a nozzle 62 for the ejection of ink and an ink supply path 64 for guiding ink from an ink reservoir (not shown) through a common ink chamber 63. A vibrating plate 65 is mounted on the bottom surface of the pressure chamber.

When an ink droplet is to be ejected, a piezoelectric actuator 66 mounted outside the pressure chamber 61 operates to displace the vibrating plate 65, whereby the volume within the pressure chamber 61 is changed and thus a pressure wave is generated therein. This pressure wave causes a part of the ink filled in the pressure chamber 61 to be ejected through the nozzle 62 as a flying ink droplet 67. The flying ink droplet lands on a recording medium such as a recording paper and forms a recorded dot thereon. Such formation of recorded dots are repeated on the basis of image data, thereby recording characters or images on the recording paper.

In order to achieve a high image quality in this type of inkjet recording head, it is necessary to minimize the diameter of the ejected ink droplet (droplet diameter). Specifically, in order to obtain a smooth image with little graininess, the recording dot (pixel) formed on the recording paper must be made as small as possible. For this reason, the diameter of the ink droplet ejected must be minimized in size. Generally, the graininess of the image decreases greatly as the dot diameter becomes 40 $\mu$m or less. As the dot diameter becomes 30 $\mu$m or less, it becomes so difficult to visually recognize the individual dots even in the highlight portion of the image that the image quality improves greatly.

The relationship between the ink droplet diameter and the dot diameter depends on the rate of flight of the ink droplet (droplet velocity), physical properties of the ink (viscosity, surface tension), the type of the recording paper, and so on. Normally, the dot diameter is about twice the size of the ink droplet diameter. Accordingly, in order to obtain a dot diameter of 30 $\mu$m or less, the ink droplet diameter must be set at 15 $\mu$m or less. In the present description, the diameter of the ink droplet (droplet diameter) refers to the diameter of a spherical droplet substituting the total amount of ink (including the satellites) ejected in a single act of ejection.

The most effective way of minimizing the ink droplet diameter is to reduce the nozzle diameter. Practically, however, the nozzle diameter cannot be reduced to less than about 25 $\mu$m, given technical difficulties in the manufacture and the fact that as the nozzle diameter is reduced, the nozzle tends to be clogged. Accordingly, it is impossible to obtain an ink diameter on the order of 15 $\mu$m solely by decreasing the nozzle diameter. To solve this problem, it is known to reduce the droplet diameter of the ejected ink droplet by way of the driving method employed, and some effective methods are proposed.

As one such example, Japanese Patent Laid-open Publication No. Sho. 55-17589 discloses a meniscus control technique whereby the pressure chamber is once expanded immediately before ejection, and then an ink droplet is ejected when the ink meniscus at the nozzle opening is drawn towards the pressure chamber. FIG. 23 shows an example of the driving waveform for driving the piezoelectric actuator using this technique. In the present description, the relationship between the driving voltage and the piezoelectric actuator operation is such that as the driving voltage increases, the volume of the pressure chamber decreases and, conversely, as the driving voltage decreases, the volume of the pressure chamber increases. Generally, the polarities are often reversed depending on the structure of the piezoelectric actuator and the direction of polarization of the piezoelectric element.

Referring to the driving waveform shown in FIG. 23, a voltage fall 71 from V1 to zero volt expands the volume of the pressure chamber. A subsequent voltage rise 71 from zero volt to V2 compresses the volume of the pressure chamber to thereby eject an ink droplet. The interval of each of the fall time t1 and rise time t2 is generally on the order of 2–10 $\mu$s, which is longer than an inherent period Ta of the conventional piezoelectric actuator.

FIGS. 25(*a*) to (*d*) illustrate the movement of the ink meniscus at the nozzle opening portion upon application of the driving waveform of FIG. 23. The ink meniscus has a flat upper portion during the initial state (FIG. 25(*a*)). As the pressure chamber is expanded immediately before the ejection, the top portion of the ink meniscus assumes a concave shape, as shown in FIG. 25(*b*). As the pressure chamber is compressed by voltage rise 71 when there is such a concave ink meniscus, a thin liquid column 83 is formed in the center of the ink meniscus as shown in FIG. 25(*c*). This is followed by the formation of an ink droplet 84 as the tip of the liquid column is separated (FIG. 25(*d*)). The ink droplet diameter is substantially equal to the thickness of the liquid column thus formed and is smaller than the nozzle diameter. Thus it is possible to eject an ink droplet with a smaller diameter than the nozzle diameter by using such driving method.

As described above, the meniscus control system enables the ejection of an ink droplet with a smaller diameter than the nozzle diameter. However, when such driving waveform as shown in FIG. 23 is used, the smallest diameter of the droplet that could actually be obtained was about 25 $\mu$m, which is still not good enough to satisfy the need for higher image quality.

FIG. 24 shows another driving waveform as a driving means for enabling the ejection of a smaller droplet. In this waveform shown in FIG. 24, a voltage fall 73 draws the ink meniscus immediately prior to the ejection. A subsequent voltage rise 74 compresses the volume of the pressure chamber and thereby causes a liquid column to be formed. A voltage fall 75 separates a droplet from the tip of the liquid column at an early period. A voltage rise 76 suppresses the reverberations of the pressure wave remaining after the ejection of the ink droplet. In other words, the driving waveform of FIG. 24 is based on the conventional meniscus control system in which a pressure wave control is incorporated for the early separation of the ink droplet and for the suppression of the reverberations. This arrangement allows an ink droplet with a droplet diameter on the order of 20 μm to be ejected in a stable manner.

However, it was still difficult to eject an ink droplet with an ink diameter of 20 μm or less easily even by using this improved driving waveform, and particularly an ink diameter of 15 μm or less was impossible. Thus, there was no driving method that could achieve the ink diameter of 15 μm or less, which was required for image quality reasons. One of the biggest reasons for this was that in the conventional inkjet recording head, the ink droplet ejection was carried out by the pressure wave that was governed by the acoustic capacity of the pressure chamber. This reason will be explained in detail below.

FIG. 26 shows the result of observation of velocity changes in the ink meniscus (particle velocity change) by a laser Doppler meter, the changes being caused when a driving waveform of FIG. 24 is applied to the piezoelectric actuator. As shown in the figure, the ink meniscus vibrates due to the pressure wave generated in the pressure chamber. In the example of FIG. 26, the inherent period Tc of the pressure wave is 13 μs, and pressure waves generated at the respective nodes of the driving waveform are superposed, resulting in a complex velocity change in the ink meniscus.

The volume of the ejected ink droplet can be thought of as substantially proportional to the product of a shaded area defined by the initial positive half-cycle of the pressure wave of FIG. 26 and the area of the nozzle opening. Namely, an estimate of the droplet diameter (drop volume) on the assumption that the ink is ejected from the nozzle with a positive rate (velocity in the direction out of the nozzle) and flies as an ink droplet corresponds well with an actually measured droplet diameter (drop volume). Although when the meniscus control system is used, a liquid column which is thinner than the nozzle diameter is formed and therefore the effective nozzle opening area decreases, the relationship where the ink droplet volume is substantially proportional to the shaded area of FIG. 26 is still valid. Accordingly, inorder to reduce the droplet diameter (drop volume), it is important to reduce the area of the above-mentioned shaded portion.

There are roughly two ways for the reduction of the shaded portion area. One sets the amplitude of the particle velocity small, as shown in FIG. 27. The other sets the period of the particle velocity vibration short, as shown in FIG. 28. The former method, by which the amplitude of the particle velocity is set small, is difficult to implement in actual applications. This is because the drop velocity is substantially proportional to the average particle velocity of the shaded portion, and so if the amplitude of the particle velocity is set small, the flying velocity (drop velocity) of the ink droplet drops significantly, which poses a problem in image recording.

Accordingly, in order to perform a minute-drop ejection, the inherent period of the pressure wave must be set very small as shown in FIG. 28. Specifically, in order to eject an ink droplet with a droplet diameter of 15 μm at a drop velocity of 6 m/s, the inherent period of the pressure wave must be set on the order of 3 to 5 μs.

However, it was very difficult to set the inherent period of the pressure wave at such small values in the conventional inkjet recording head. This was because of the fact that in order to obtain the inherent period on the order of 3 to 5 μs, the volume of the pressure chamber must be set very small and at the same time the rigidity of the walls forming the pressure chamber must be very high, as will be described later. Those measures, however, are difficult to realize in the conventional head manufacturing method where the pressure chamber is constructed by stacking and bonding perforated board materials.

Even if the above-mentioned conditions are met, the reduction in the limit ejection frequency of the ink droplet cannot be avoided. Specifically, while it is necessary to set the volume of the pressure chamber small in order to shorten the inherent period of the pressure wave, a certain area must be secured for the actuator unit for the application of displacements by the piezoelectric actuator, which necessarily results in the pressure chamber having a flat shape. As a result, the flow-path resistance of the pressure chamber significantly increases, which in turn lengthens the refill time (the time for the returning of the ink meniscus after ejection), thereby making it difficult to repeat the ejection at a high frequency.

As explained above, the conventional inkjet recording head had the disadvantage that it is unable to eject an ink droplet with such a droplet diameter as required for the significant improvement of the image quality, namely a minute ink droplet with a droplet diameter on the order of 15 μm.

SUMMARY OF THE INVENTION

An object of the present invention is to provide a method of driving an inkjet recording head which is capable of ejecting an ink droplet with a droplet diameter of 15 μm or less without adversely affecting the ejection property in the high-frequency region and without requiring a specialized head manufacturing technology, and to provide an inkjet recording apparatus using such driving method.

Another object of the present invention is to enable both high-quality and high-speed recording by ensuring a wide range of droplet diameter modulation when performing a grayscale recording by modulating the droplet diameter of the ejected ink droplet in multiple levels.

In order to achieve those objects, the present invention is directed to a method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta, said method characterized in that:

said driving voltage has a first driving voltage waveform, said first driving voltage waveform including consecutively a first waveform portion having a first time length t1 for contracting a volume of said pressure chamber and a second waveform portion having a second time length t2 for expanding the volume of said pressure chamber, said first and second time lengths t1 and t2 being set equal to or longer than the inherent vibration period Ta of said electro-mechanical transducer.

An inkjet recording apparatus according to the present invention includes: an inkjet recording head including a pressure chamber having an ink supply port for supplying a liquid ink and an ink nozzle for ejecting the ink as at least one ink droplet, the pressure chamber being filled with liquid ink, and an electro-mechanical transducer disposed such that the ink droplet is ejected from the ink nozzle by the generation of a pressure wave in the pressure chamber by application of a driving voltage, the transducer having an inherent vibrating period Ta; and a driving waveform generating circuit for generating one or more driving waveforms for the driving voltage to be applied to the electro-mechanical transducer, wherein:

the driving waveform includes a first waveform portion having a first time length for the compression of the volume of the pressure chamber and a second waveform portion having a second time length for the expansion of the volume of the pressure chamber, the first and second time lengths being set equal to or longer than the inherent vibrating period Ta of the electro-mechanical transducer.

In accordance with the method of driving the inkjet recording head and the inkjet recording apparatus according to the invention, the electro-mechanical transducer element is actuated by a driving waveform having a rise time and a fall time which are shorter than the inherent vibrating period of the electro-mechanical transducer element, whereby a minute ink droplet having a diameter of 15 $\mu$m or less can be ejected from the ink nozzle and therefore the printing precision can be improved.

PREFERRED EMBODIMENTS OF THE INVENTION

Before describing the preferred embodiments of the present invention, the principle of the present invention will be described based on the result of theoretical analysis of the inkjet recording head by referring to a lumped-constant circuit model.

Figure 1:
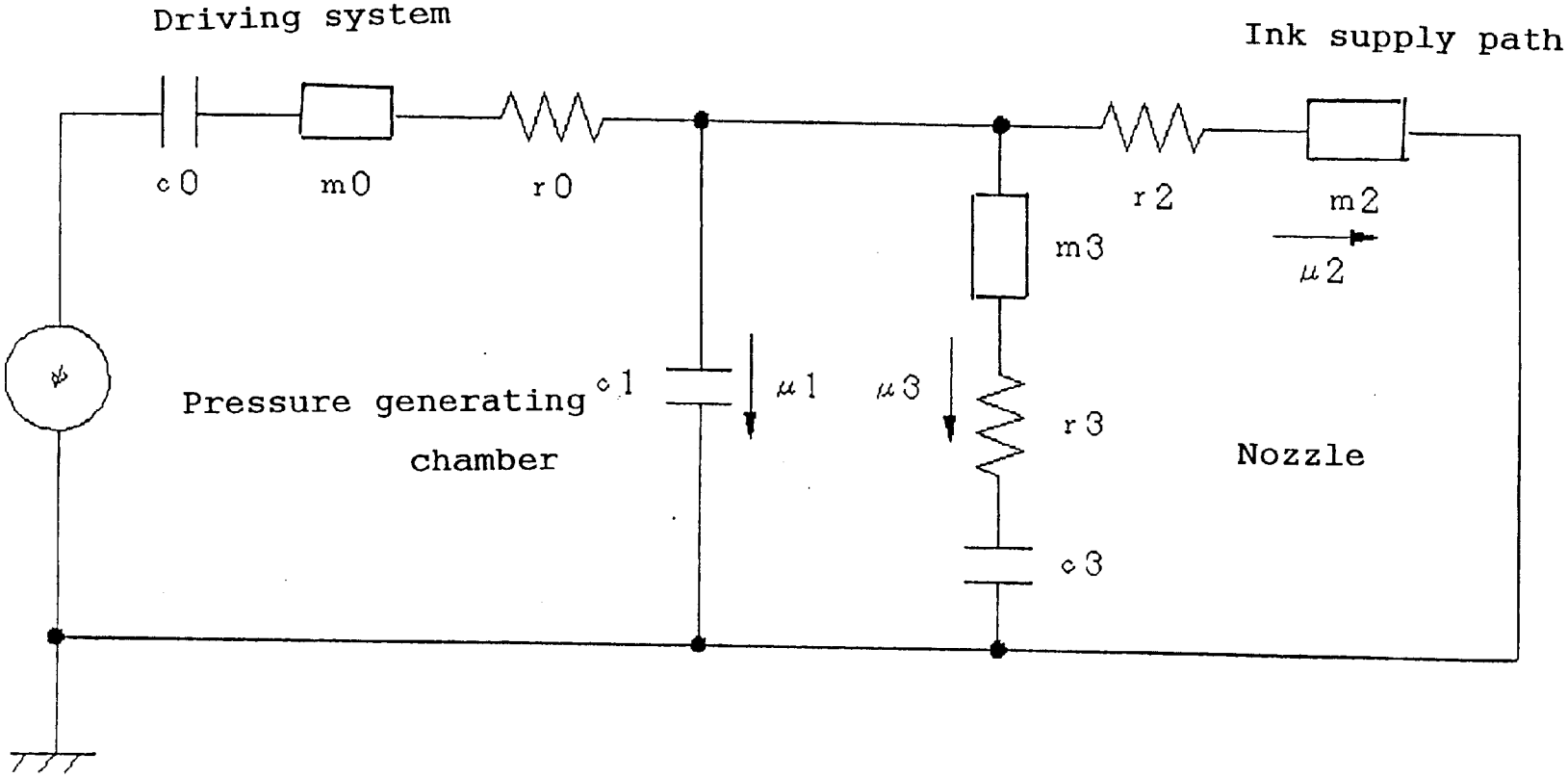
FIG. 1 is an equivalent circuit diagram of the inkjet recording head in accordance with the principle of the present invention.

FIG. 1 shows a circuit diagram of the general ink jet recording head as substituted by an equivalent electric circuit. In the figure, reference m designates an inertance [kg/m$^4$], reference r designates an acoustic resistance [Ns/m$^5$], reference c designates an acoustic capacitance [m$^5$/N], and reference u designates a volume rate [m$^3$/s], and reference $\phi$ designates a pressure [Pa]. Indexes [0], [1], [2], and [3] designate the actuator unit, pressure chamber, ink supply path, and nozzle, respectively.

Figure 2:
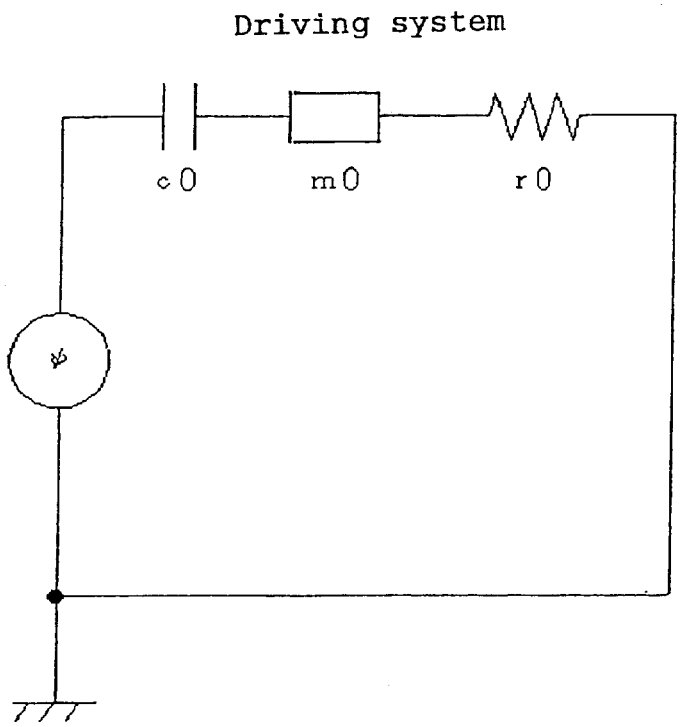
FIG. 2 shows a part of the equivalent circuit of FIG. 1.
Figure 3:
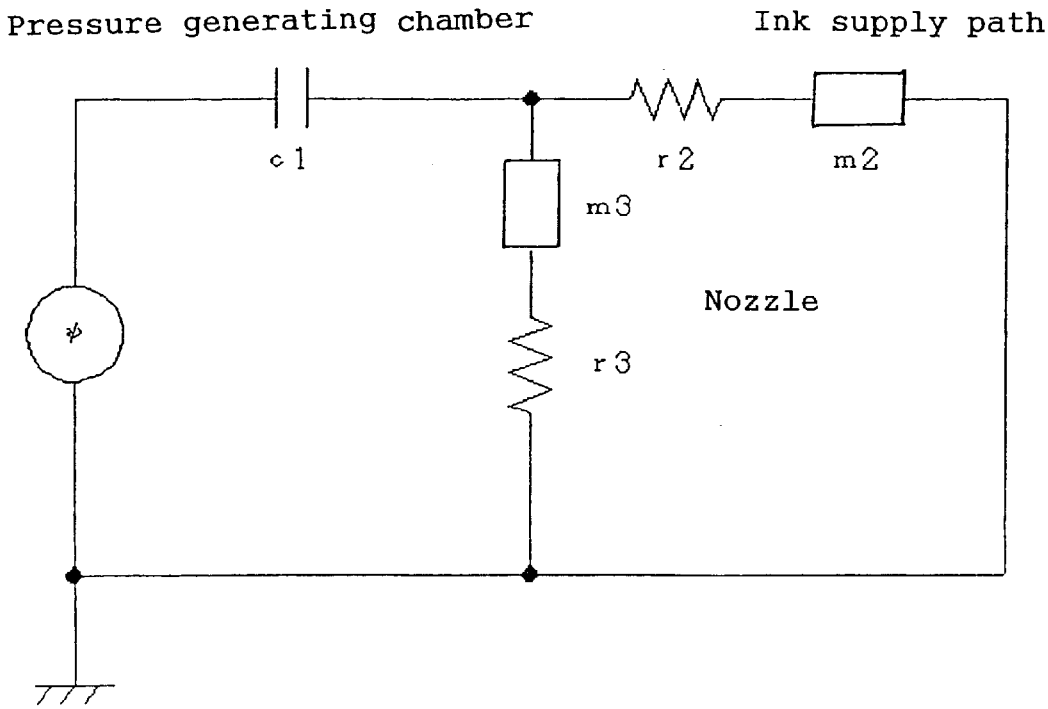
FIG. 3 shows another part of the equivalent circuit of FIG. 1.
Figure 4:
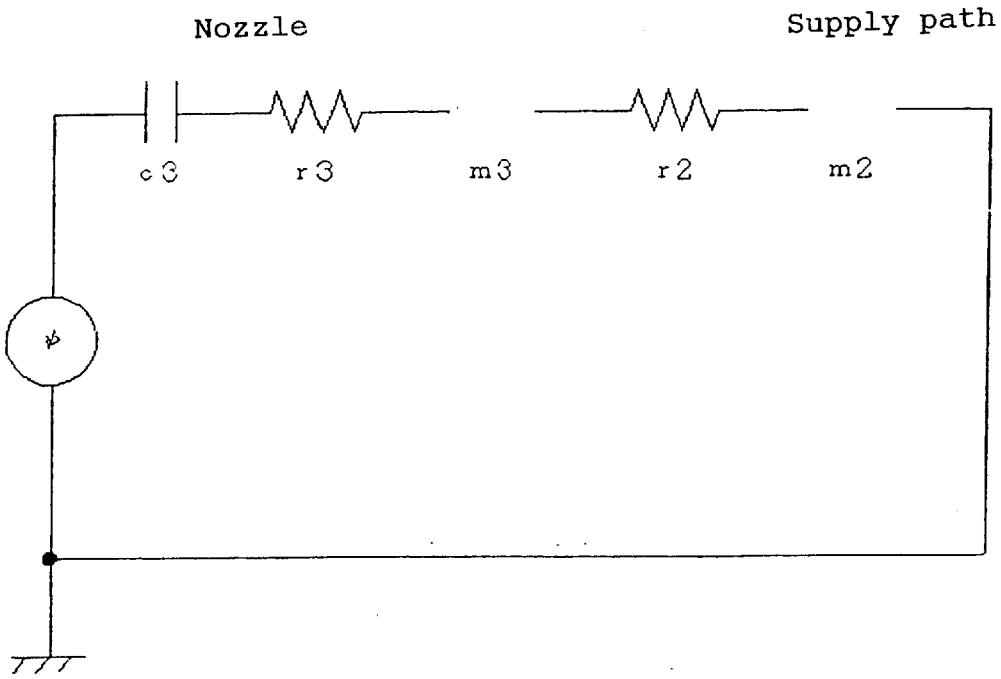
FIG. 4 shows another part of the equivalent circuit of FIG. 1.

In the conventional inkjet recording head, when a piezoelectric actuator that operates in a longitudinal vibration mode is used, the circuit of FIG. 1 can be thought of as consisting of the three circuits shown in FIGS. 2–4. FIG. 2 shows a circuit relating to the actuator unit having a piezoelectric actuator and a vibrating plate. Its inherent period Ta can be expressed by the equation:

$$Ta=2\pi\sqrt{m_0c_0}.$$

The inherent period Ta of the circuit of FIG. 2 can be considered as an inherent period of a bar with a fixed-end and a free-end longitudinally vibrating, and can be approximately determined by the equation:

$$Ta = 4L\sqrt{\frac{\rho_p}{E_p}},$$

where L is the length of the piezoelectric actuator, $\rho_p$ and Ep are density and coefficient of elasticity of the piezoelectric actuator material, respectively. Ta is on the order of 1–5 $\mu$s in the conventional inkjet recording head.

The partial circuit of FIG. 3 includes a pressure chamber referenced by an acoustic capacitance c1 of the pressure chamber. The pressure wave generated by the inherent vibrating mode within the pressure chamber is defined by the circuit of FIG. 3. Namely, in the conventional inkjet recording head, the ejection of the ink droplet is carried out by the pressure wave defined by this circuit. An inherent period Tc of the circuit of FIG. 3 is expressed by the equation:

$$Tc = 2\pi\sqrt{\frac{m_2 m_3}{m_2 + m_3}\cdot c1}.$$

Tc is on the order of 10–20 $\mu$s in the conventional inkjet recording head.

Acoustic capacitance c1 of the pressure chamber is expressed by the equation:

$$c1 = \frac{W_1}{k\cdot K_1}$$

wherein W1[$m^3$] is the volume of the pressure chamber, κ[Pa] is the volume coefficient of elasticity of the ink, and K1 is a constant dependent on the rigidity of the pressure chamber wall.

Thus, in order to decrease inherent period Tc, it is desirable to set volume W1 of the pressure chamber smaller and set the rigidity of the pressure chamber wall higher (set K1 larger).

The circuit of FIG. 4 is a circuit which is governed by acoustic capacitance c3 by the surface tension of the ink meniscus and is related to the refill property. An inherent period Tm of the circuit of FIG. 4 is expressed by the following equation:

$$Tm=2\pi\sqrt{(m_{2+m_3})c_3}.$$

Tm is on the order of 20–50 $\mu$s in the conventional inkjet recording head.

In the circuits of FIGS. 2–4, the present invention utilizes the properties of the circuits of FIGS. 2 and 3. In particular, while the conventional inkjet recording head utilized the properties of the circuit of FIG. 3 for the ejection of the ink droplet, the present invention uses the inherent vibration of the actuator unit (piezoelectric actuator) per se for the ejection of the ink droplet.

Figure 5:
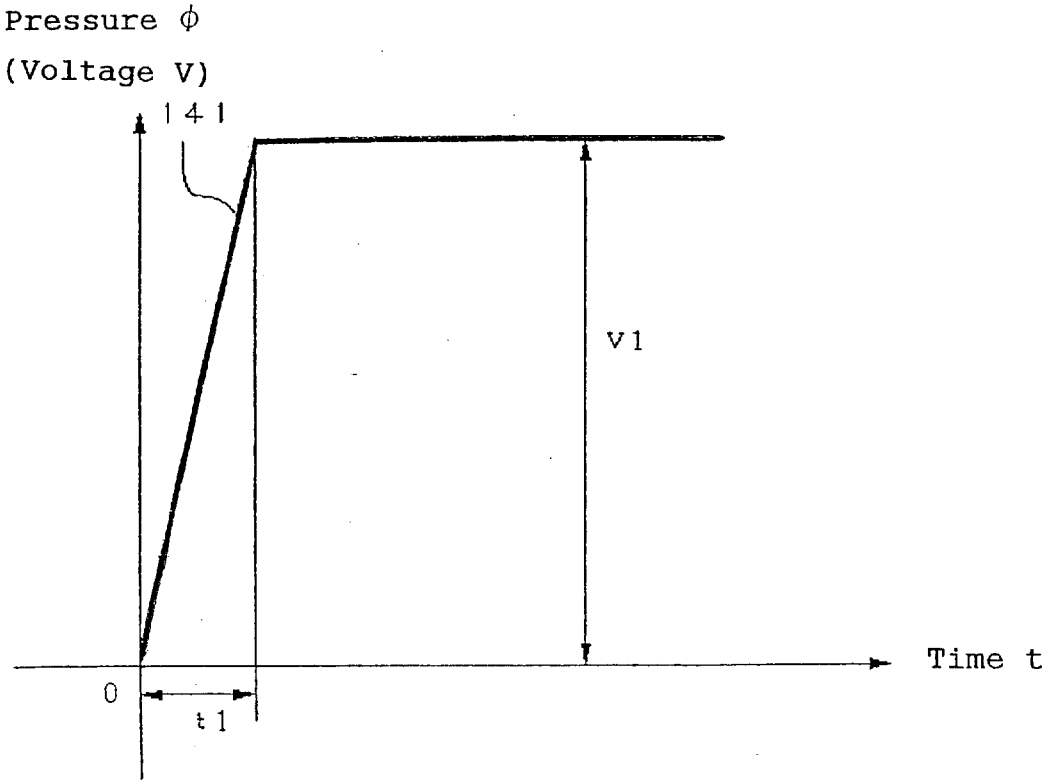
FIG. 5 is a chart showing the driving waveform of the driving voltage having a voltage rise portion for use in the invention.
Figure 8:
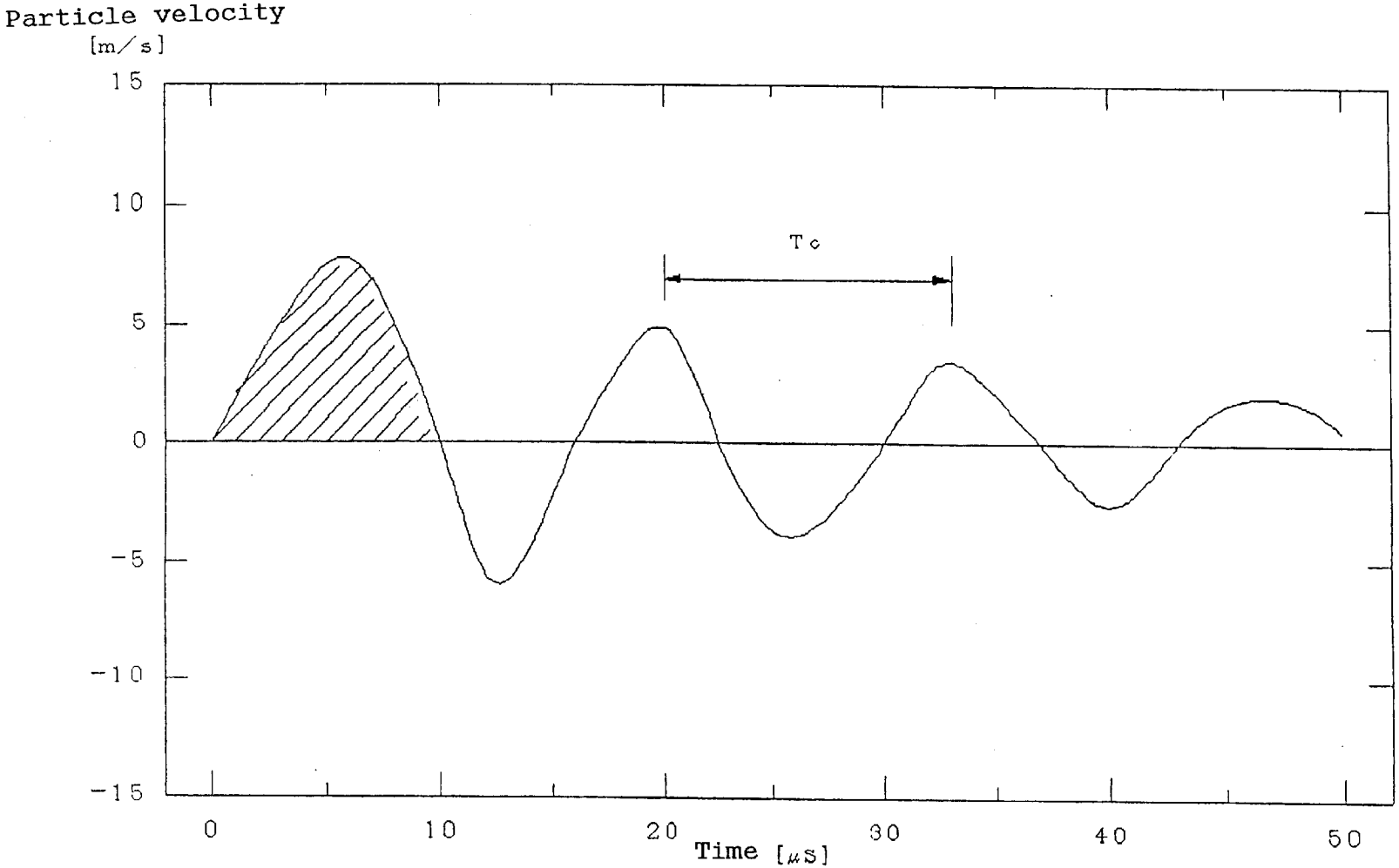
FIG. 8 is a graph showing the drop velocity at the nozzle portion against time in the case of the driving waveform of FIG. 5 having a larger rise time than the inherent period of the pressure chamber.
Figure 9:
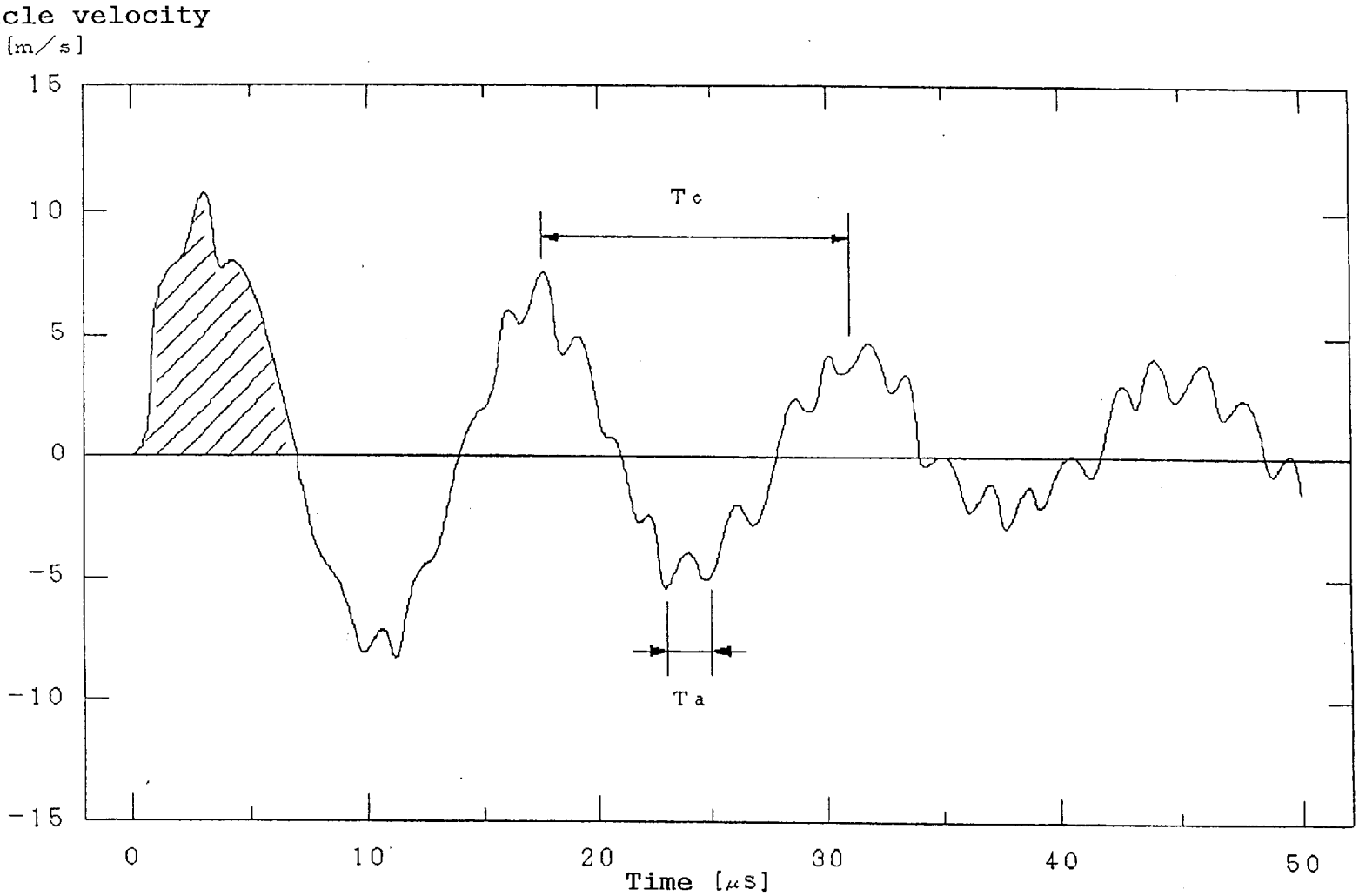
FIG. 9 is a graph showing the drop velocity at the nozzle portion against time in the case of the driving waveform of FIG. 5 having a smaller rise time than the inherent period of the pressure chamber.
Figure 22:
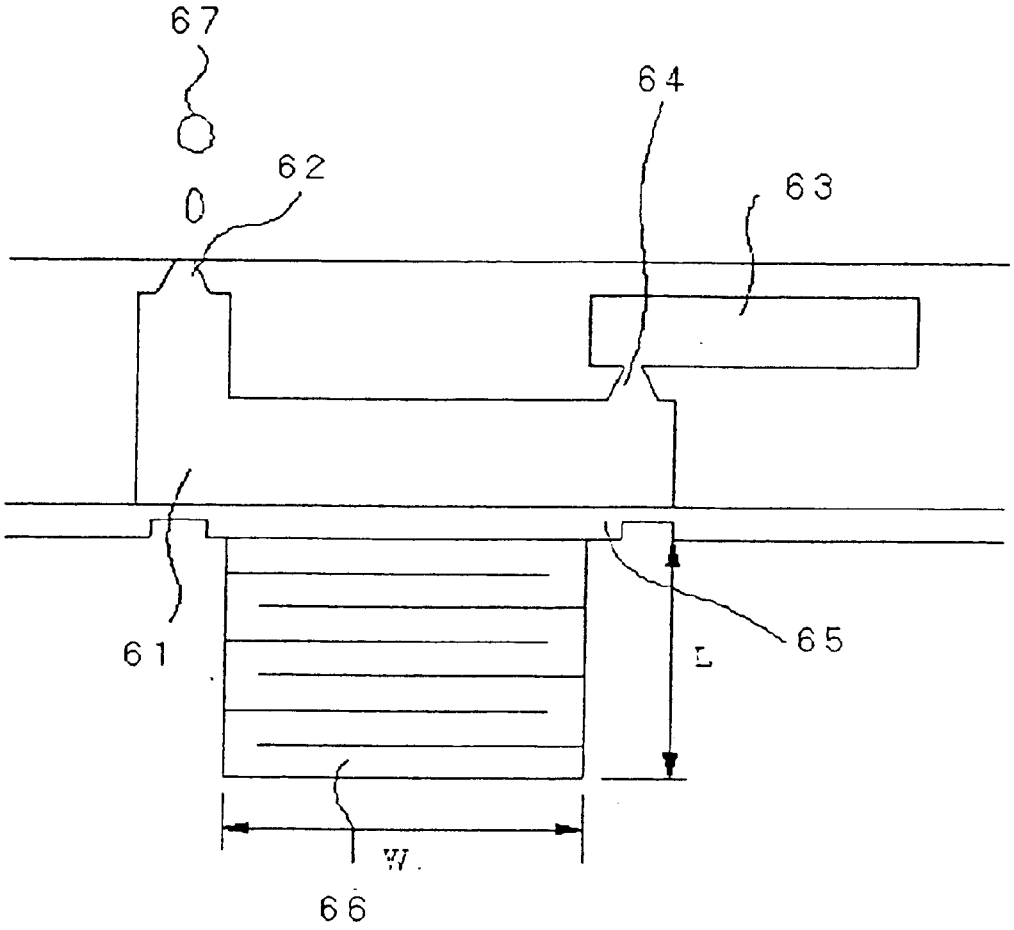
FIG. 22 is a depiction of a Kaiser-type inkjet recording head.
Figure 23:
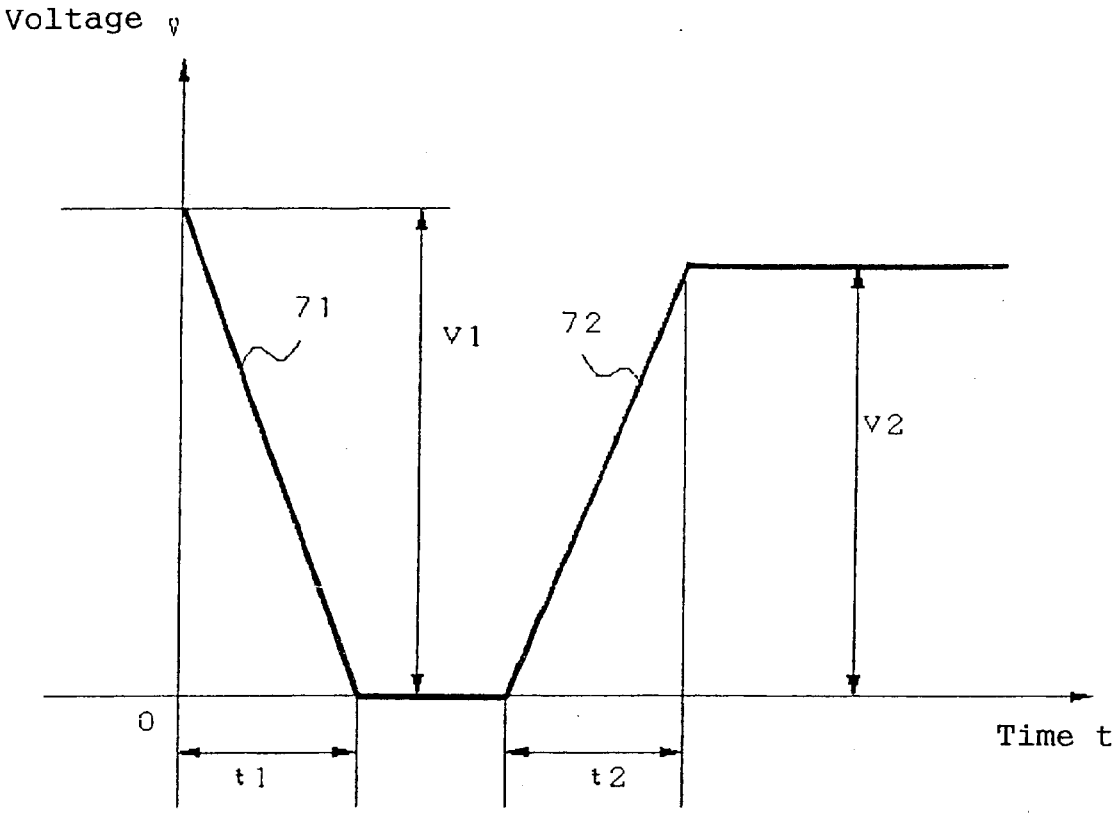
FIG. 23 is another chart showing a driving waveform.

FIG. 5 shows an example of a pressure (pressure wave) ϕ within the pressure chamber shown in FIG. 22 in proportion to the driving voltage. FIGS. 8 and 9 each show a drop velocity v3 (particle velocity) at the opening of the nozzle related to the pressure wave of FIG. 5. Particle velocity v3 is equal to the quotient when a volume velocity u3 is divided by the area of opening of the nozzle.

FIG. 8 shows the particle velocity in the inkjet recording head when rise time t1 of pressure ϕ is set larger than inherent period Ta of the circuit, used in the method of driving the conventional inkjet recording head. Particle velocity v3 vibrates at an inherent period Tc. Thus, particle velocity v3 is defined only by the circuit of FIG. 3 in the conventional inkjet recording head.

FIG. 9 shows particle velocity v3 of the inkjet recording head when rise time t1 of pressure ϕ is set equal to or smaller than inherent period Ta of the actuator unit in accordance with the principle of the present invention. In this case, the inherent vibration of the actuator unit of FIG. 2 is excited, and, as a result, the vibration of particle velocity v3 corresponds to the vibration of inherent period Tc superposed with the vibration of inherent period Ta. In other words, by setting the rise time of pressure ϕ equal to or smaller than inherent period Ta, the ink meniscus can be vibrated at the inherent period of the piezoelectric actuator per se.

Figure 6:
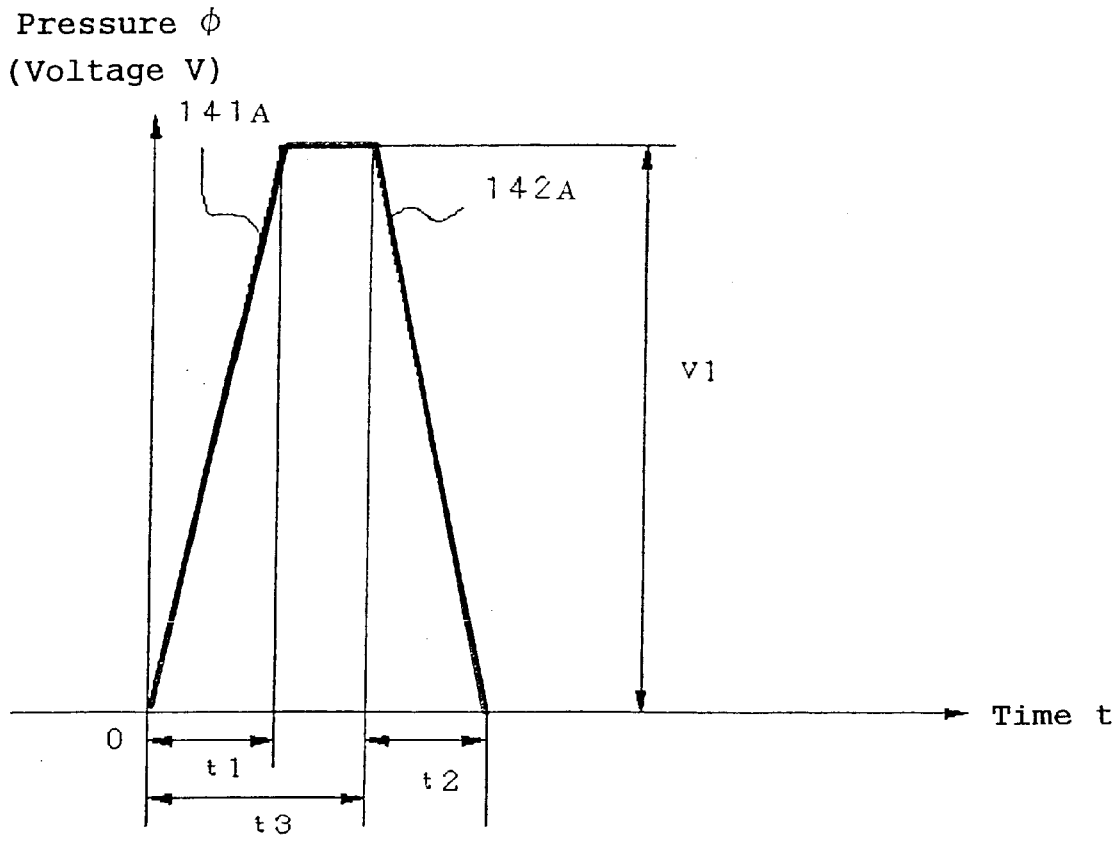
FIG. 6 is a chart showing the driving waveform of the driving voltage having a voltage rise portion and a voltage fall portion for use in the invention.
Figure 10:
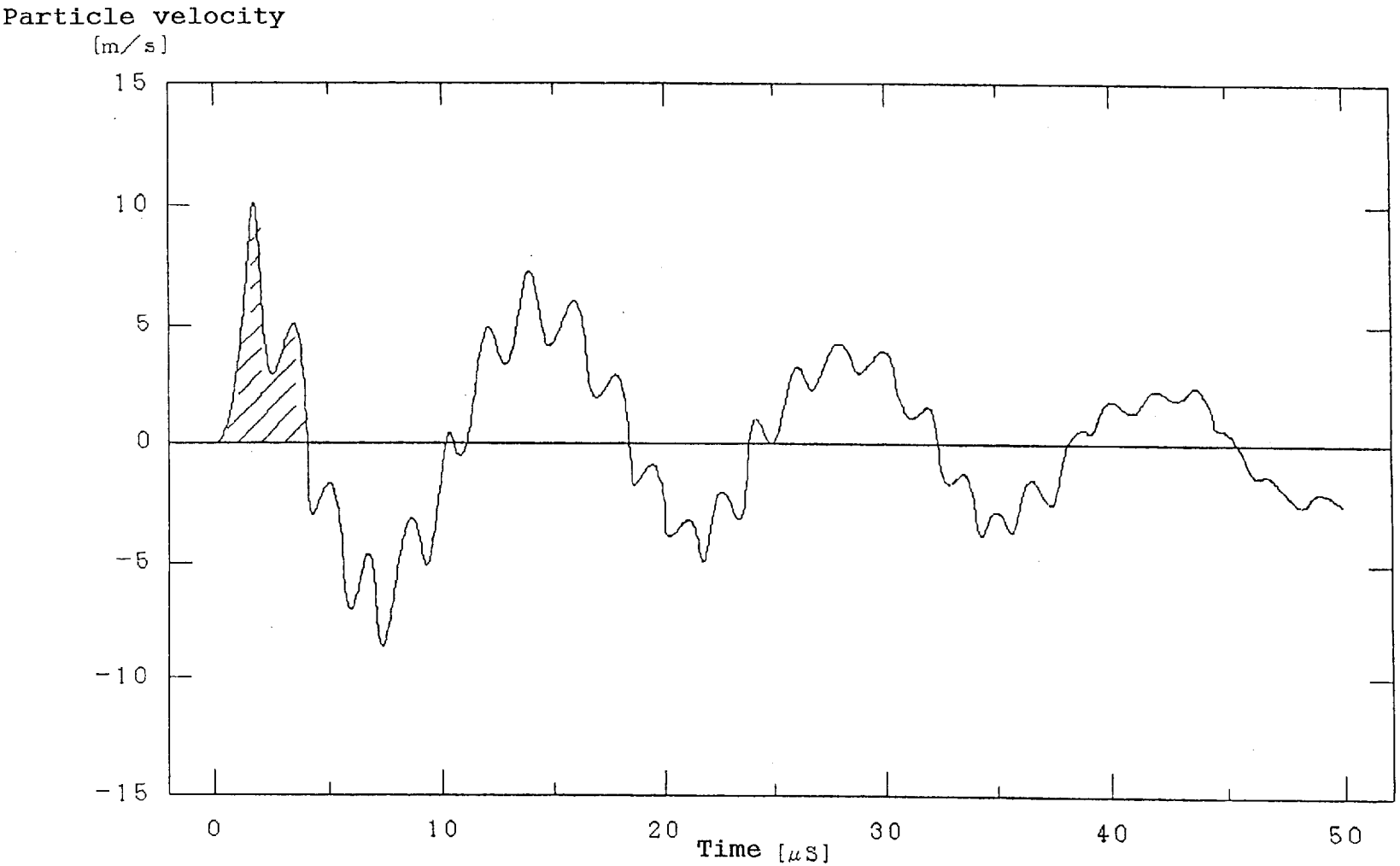
FIG. 10 is a graph showing the drop velocity at the nozzle portion against time in the case of the driving waveform of FIG. 6.

Referring to FIG. 6, there is shown the case where the pressure wave generated in the pressure chamber is trapezoidal in shape. In the figure, rise time t1 and fall time t2 are both set equal to or smaller than inherent period Ta of the circuit, and the time difference (t3) between the start time of voltage rise and the start time of voltage fall is set such that $Ta/2 \leqq t3 \leqq Ta$. As the pressure wave of FIG. 6 is generated in the pressure chamber, particle velocity v3 of the ink meniscus varies as shown in FIG. 10. In this case, the piezoelectric actuator is sharply elongated by a voltage rise portion 141A of FIG. 6, and a voltage fall 142A for contracting the piezoelectric actuator is applied in synchronism with the timing of contraction of the elongated piezoelectric actuator by its own inherent vibration. As a result, the piezoelectric actuator sharply contracts and particle velocity v3 returns to the position of FIG. 10 where v3–0 at a very quick timing. Thus, the area of the shaded portion corresponding to the initial positive half cycle of the particle vibration becomes smaller than the shaded portion of FIG. 9, so that there can be obtained a favorable condition for the ejection of a small drop.

When pressure ϕ is made trapezoidal in shape as shown in FIG. 6, the initial positive half cycle of the particle velocity of FIG. 10 will contain a plurality of ridges as shown in FIG. 10. In this case, the area of the shaded portion may increase, i.e., the diameter of the ink droplet may increase, resulting in the creation of a satellite ink droplet and at the same time an unstable ejection may result.

Figure 7:
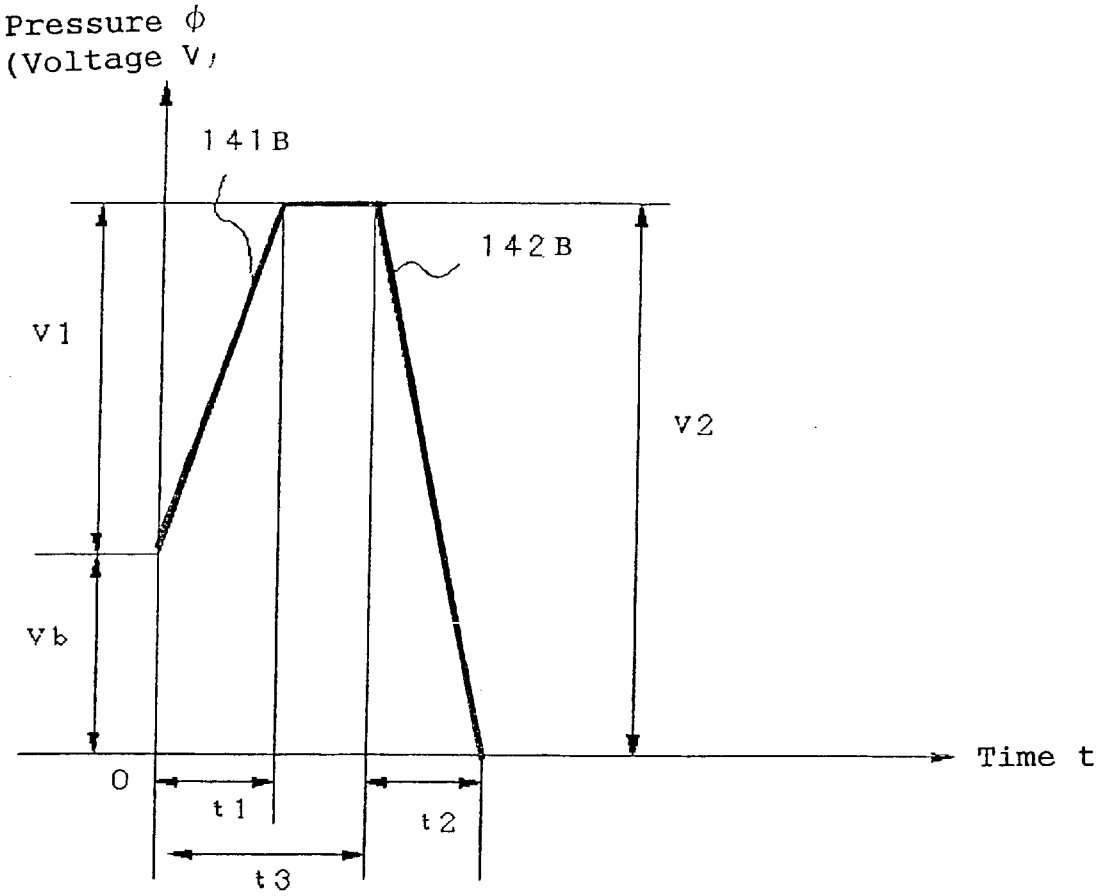
FIG. 7 is another chart showing the driving waveform of the driving voltage having a voltage rise portion and a voltage fall portion for use in the invention.
Figure 11:
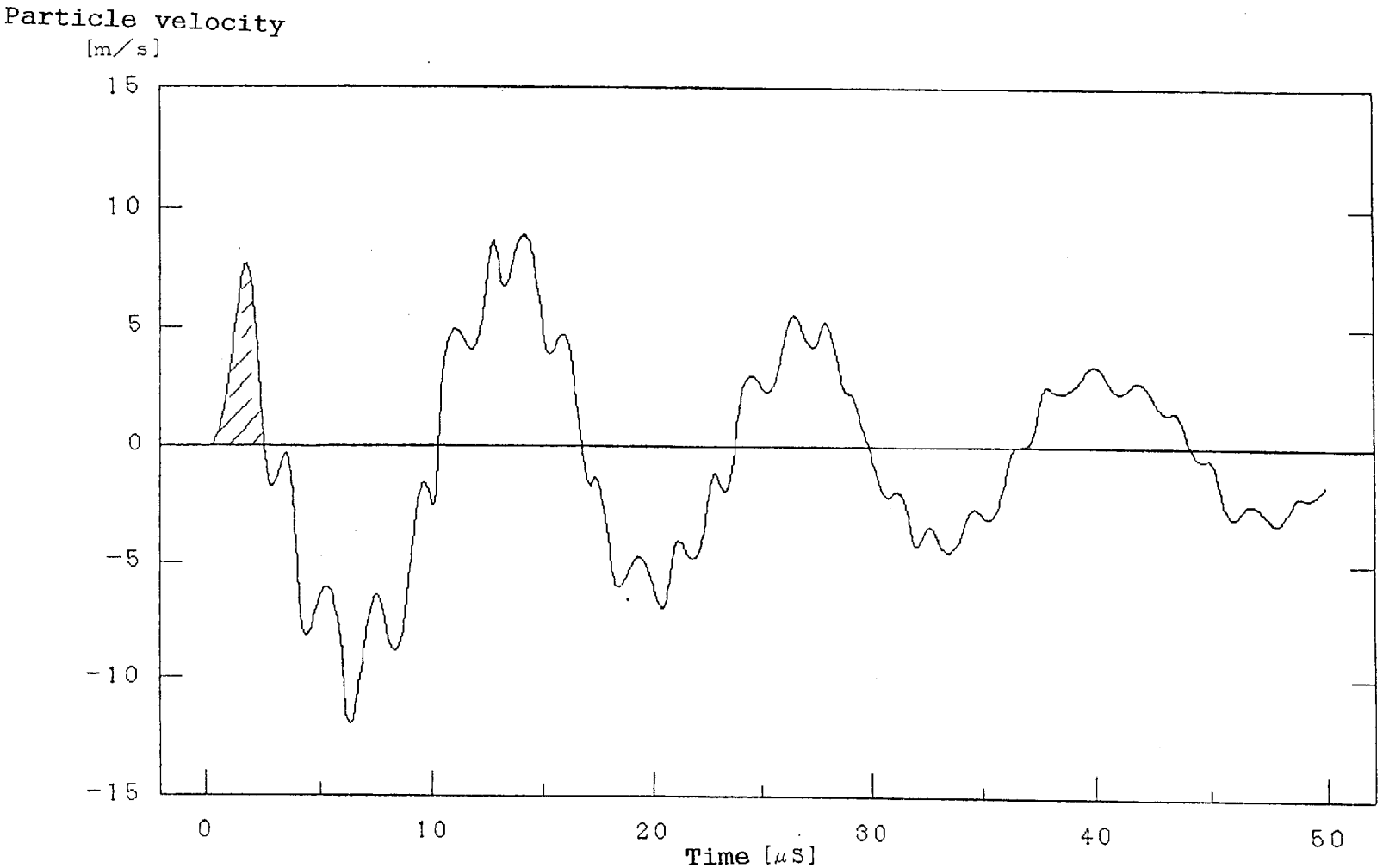
FIG. 11 is a graph showing the drop velocity of the nozzle portion against time in the case of the driving waveform of FIG. 7.

To prevent such a scenario, it is preferable to have such a variation of pressure ϕ as shown in FIG. 7. The pressure wave of FIG. 7 has its shaded portion formed by a single maximum point as shown in FIG. 11 by setting the amount of pressure drop 142B greater than the amount of pressure rise 141B. The single maximum point permits a reduction of the area of the shaded portion, thereby allowing for a stable ink ejection.

As explained above, the inherent period of the ink meniscus vibration can be greatly reduced by setting the rise/fall time of the driving waveform equal to or smaller than the inherent period Ta of the piezoelectric actuator and at the same time by setting time difference t3 between the rise start and drop start time such that $Ta/2 \leqq t3 \leqq Ta$. By so doing, the area of the shaded portion can be reduced as shown in FIGS. 10 and 11, whereby it becomes possible to eject a smaller drop than in accordance with the conventional driving methods. Further, by setting the voltage change amount of the drop portion larger than the voltage change amount of the rise portion, an even smaller ink droplet can be ejected.

In the following, the present invention will be described by way of preferred embodiments. The principle of the invention was applied to a sample of the inkjet recording head having the basic structure of FIG. 22.

The sample of the inkjet recording head was produced by stacking and bonding a plurality of thin plates perforated by etching and the like. In the present embodiment, stainless plates with a thickness of 50–75 μm were bonded by means of an adhesive layer (about 20 μm in thickness) including a thermosetting resin. Its head has a plurality of pressure chambers 61 arranged in a direction perpendicular to the sheet of FIG. 22. The pressure chambers 61 are connected by a common ink chamber 63. The common ink chamber 63 is connected to an ink reservoir (not shown) and operates to guide ink to the respective pressure chambers 61.

Each of the pressure chambers 61 is communicated to the common ink chamber 63 via an ink supply path 64, and the pressure chamber 61 is filled with ink. Each of the pressure chambers 61 is also provided with a nozzle 62 for the ejection of ink.

In the present embodiment, the nozzle 62 and the ink supply path 64 have an identical shape, with an opening diameter of 30 μm, a hem diameter of 65 μm and a length of 75 μm, thus forming a tapered shape. The perforation was given by a press.

The bottom surface of the pressure chamber 61 has a vibrating plate 65, and the volume of the pressure chamber can be increased or decreased by a piezoelectric actuator (piezoelectric vibrator) 66 as the electro-mechanical transducer mounted externally to the pressure chamber 61. In the present embodiment, a nickel thin plate formed by electroforming is used for the vibrating plate 65.

The piezoelectric actuator 66 was a stacked piezoelectric ceramics. The shape of the driving column for the application of displacements to the pressure chamber 61 is 1.1 mm in length (L), 1.8 mm in width (W) and 120 μm in depth (along the direction perpendicular to the sheet of FIG. 22). The piezoelectric material used had a density ρ p of $8.0\times10^3$ kg/m3, and a coefficient of elasticity Ep of 68 GPa. The measured inherent period Ta of the piezoelectric actuator per se was 1.6 μs.

As the volume of the pressure chamber 61 is varied by the piezoelectric actuator 66, a pressure wave is generated in the pressure chamber 61. The pressure wave moves the ink of the nozzle portion 62, whereby an ink droplet 67 is formed. In the present invention, inherent period Tc of the head is 14 μs.

Next, the basic configuration of the driving circuit for driving the piezoelectric actuator will be described by referring to FIGS. 12 and 13.

Figure 12:
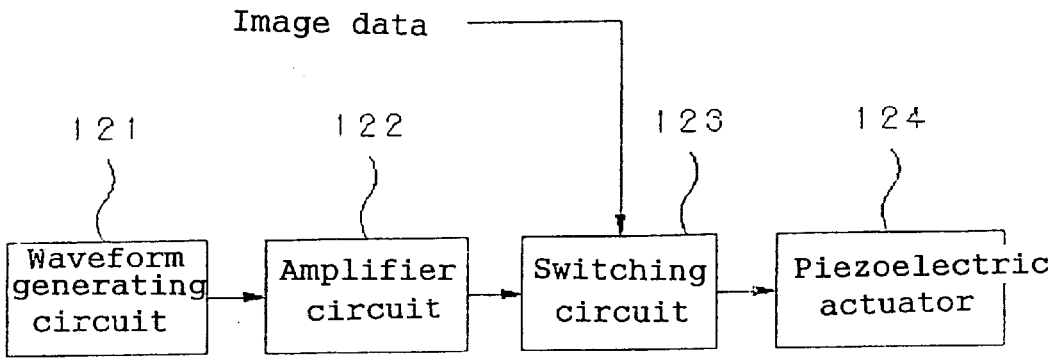
FIG. 12 is a block diagram of a configuration of the driving circuit for the piezoelectric actuator.

FIG. 12 shows an example of the configuration of the driving circuit in the case where the diameter of the ejected ink droplet is fixed, i.e., there is no ink diameter modulation. The driving circuit shown in FIG. 12 includes a waveform generating circuit 121, an amplifier circuit 122 and a switching circuit (transfer gate circuit) 123 for driving a piezoelectric actuator 124. An driving waveform signal is generated and power-amplified, and then supplied to the piezoelectric actuator for driving the same, such that characters and images are printed on a sheet of recording paper. The waveform generating circuit 121 is composed of a digital-analog converter circuit and an integrating circuit. It analog-converts the driving waveform data and then integrates the data in order to generate a driving waveform signal. The amplifier circuit 122 voltage- and current-amplifies the driving waveform signal supplied from the waveform generating circuit 121 and outputs the signal as an amplified driving waveform signal. The switching circuit 123 controls the on-off of the ink droplet ejection by applying the driving waveform signal to the piezoelectric actuator 124 on the basis of a signal generated from the image data.

Figure 13:
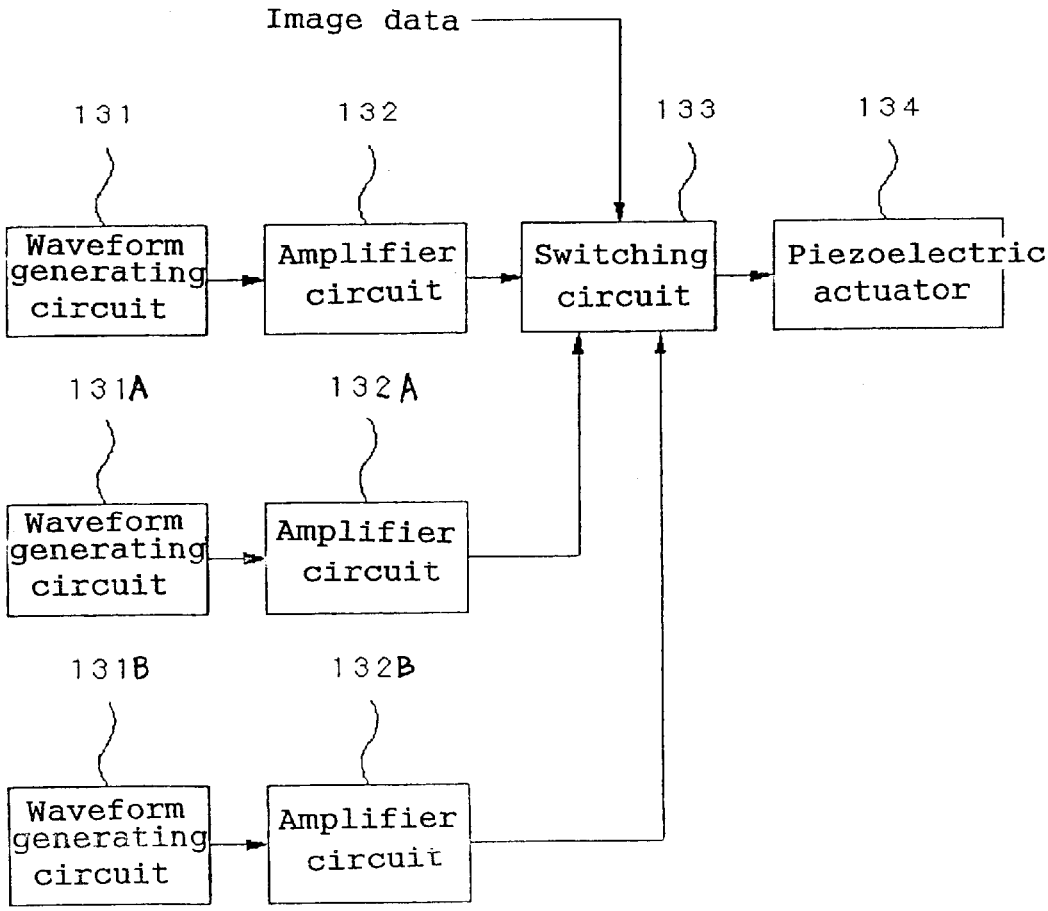
FIG. 13 is a block diagram of another configuration of the driving circuit for the piezoelectric actuator.

FIG. 13 shows an example of the configuration of the driving circuit in the case where the diameter of the ejected ink droplet is switched in multiple levels, i.e. an ink diameter modulation is carried out. The driving circuit of FIG. 13 includes three kinds of waveform generating circuits 131, 131A and 131B for modulating the droplet diameter in three levels (large, middle and small), respectively, and the individual waveforms are amplified by amplifier circuits 132, 132A and 132B, respectively. During recording, the driving waveform to be applied to the piezoelectric actuator 134 is switched by the switching circuit 133 based on the image data, such that an ink droplet of a desired diameter can be ejected.

It should be noted that the configuration of the driving circuit for driving the piezoelectric actuator is not limited to that of FIG. 12 or 13, and other configurations may be used.

Figure 14:
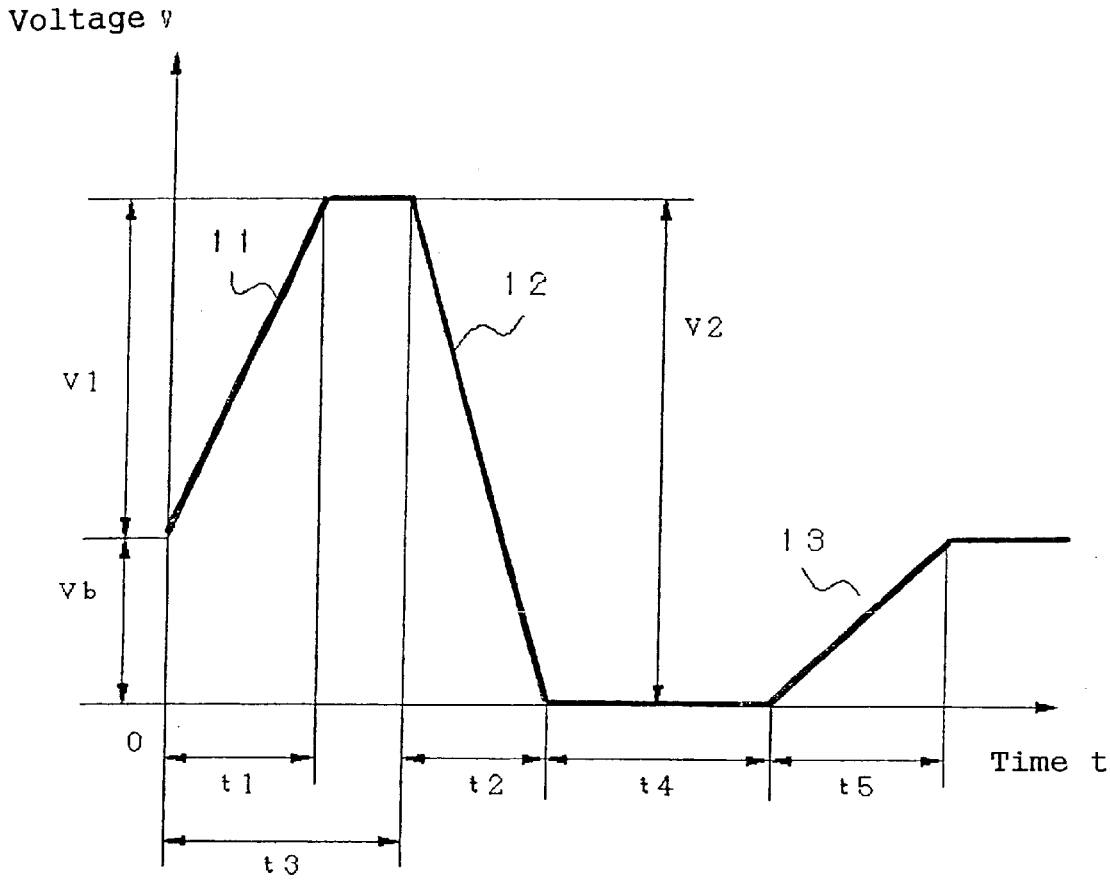
FIG. 14 is an exemplary chart of the driving waveform to be used in the method of driving the inkjet recording head according to an embodiment of the invention.
Figure 19:
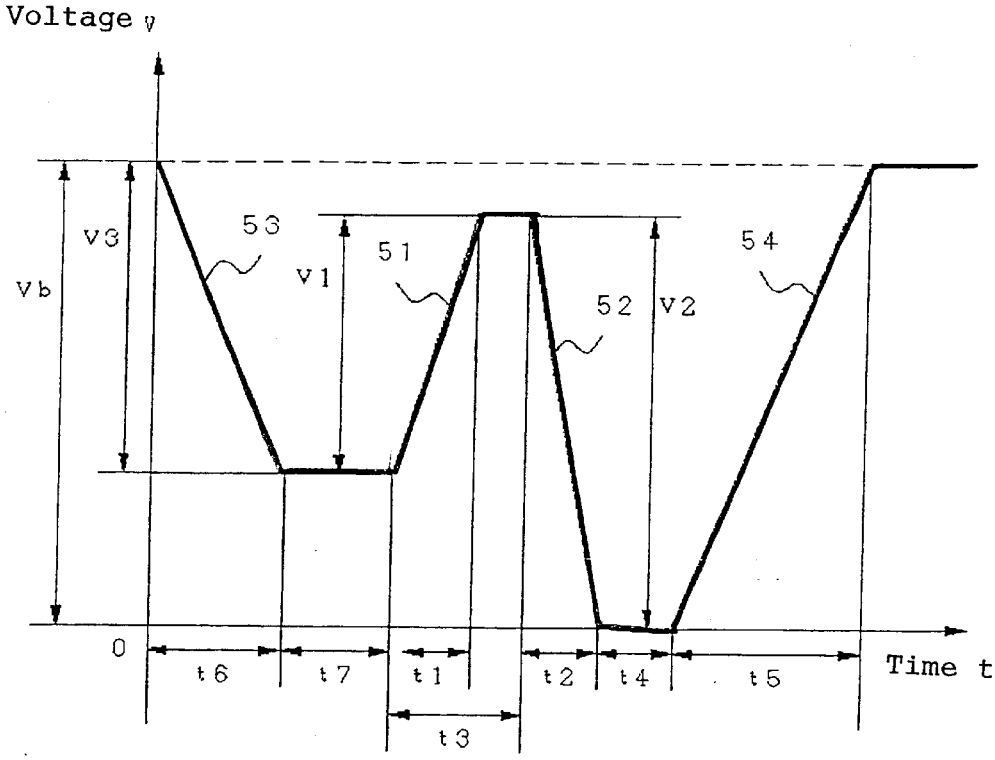
FIG. 19 is a chart showing a driving waveform to be used in the method of driving the inkjet recording head in another embodiment of the invention for producing a small ink droplet in accordance with another embodiment of the invention.

FIG. 14 shows an example of the driving waveform generated by the driving circuit of FIG. 19 for the formation of an ink droplet with a diameter of about 20 μm by using the inkjet recording apparatus according to the embodiment of the invention. The driving waveform has a rise time t1 (0.5 μs) which is shorter than the inherent period Ta (1.6 μs), and a first rise portion 11 increasing from an initial voltage Vb (6 volts) to V2 (20 volts) for contracting the pressure chamber. The waveform further includes a first drop portion 12 which starts a t3 time after the start time of the first rise portion, has a fall time t2 (0.5 μs) which is shorter than inherent period Ta, and drops from V2 to zero volt. The drop portion 12 expands the pressure chamber. Furthermore, the waveform has a second rise portion 13 which starts a t4 (14 μs) after the end of the drop portion 12 and has a rise time t5 (30 μs) for returning from zero volt to initial voltage Vb. By this arrangement, t3 satisfies $Ta \leqq t3 \leqq 3Ta$.

Figure 15:
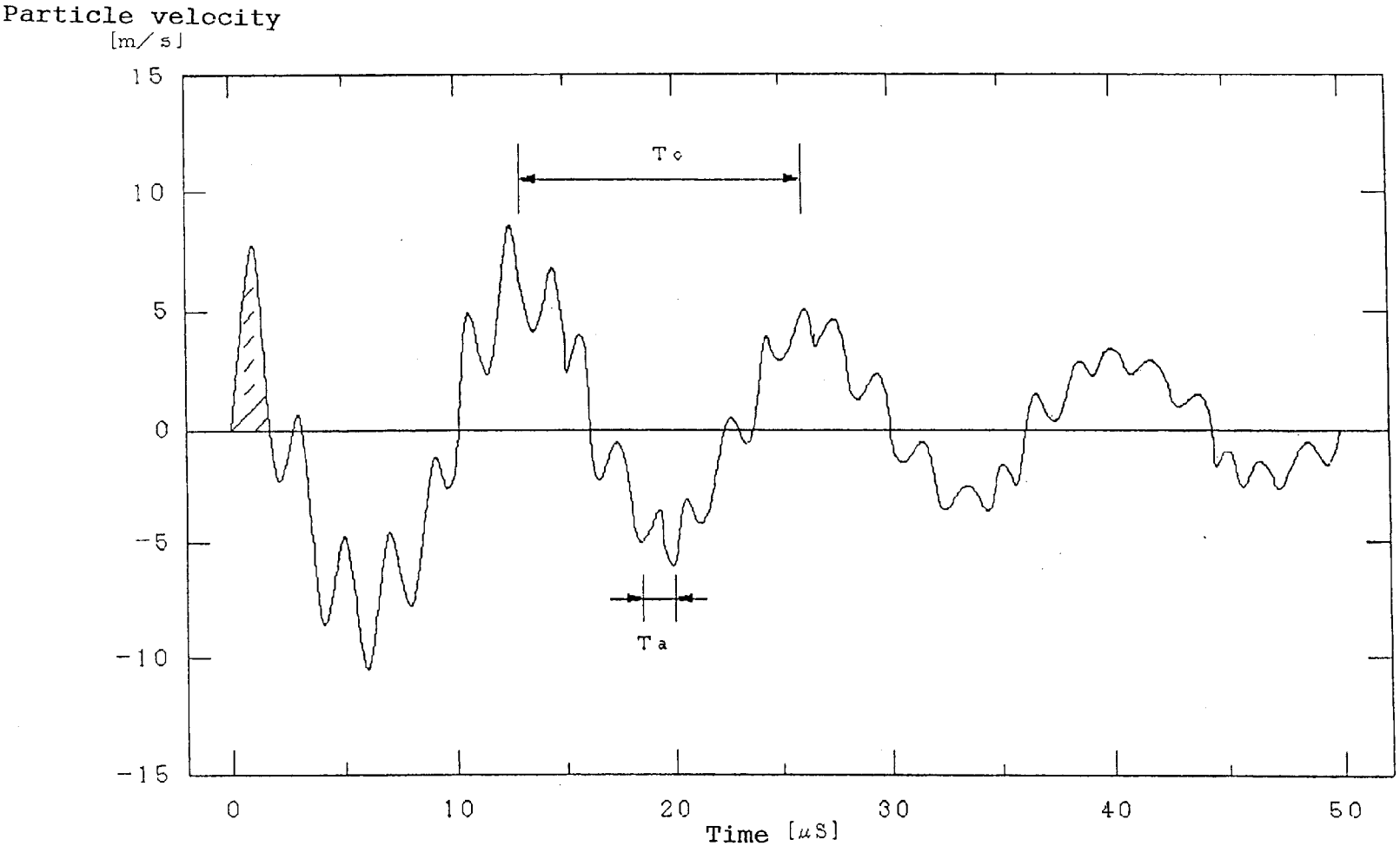
FIG. 15 is a graph showing the drop velocity at the nozzle portion actuated by the driving waveform of FIG. 14.

FIG. 15 shows the result of observation of the movement of the ink meniscus by a laser Doppler meter when the driving waveform of FIG. 14 was applied. During the observation, in order to measure the movement of the ink meniscus accurately, the application voltage was set low at 1/15, and the results of FIG. 15 indicate values obtained by multiplying the measured particle velocity by a factor of 15, in light of the fact that particle velocity v3 is proportional to the applied voltage.

In FIG. 15, the ink meniscus vibrates where the vibration of inherent period Ta and the vibration of inherent period Tc are superposed. Since the piezoelectric actuator is contracted at the timing of t3=1 μs, the initial maximum point returns to the point where v3=0 at a very early point of t=2 μs. Thus, the area of the shaded portion of the initial half cycle is very small, which is advantageous for the ejection of a minute drop.

When an ejection experiment was actually conducted by using the sample head with the driving waveform of FIG. 14, it was observed that an ink droplet with a diameter of 21 μm was ejected at a drop velocity of 5.5 m/s. When the experiment was conducted by using a driving waveform where t1=t2=t3=2 μs>Ta, as in the conventional driving method, the minimum diameter of the minute drop that could be ejected was 28 μm.

Figure 16:
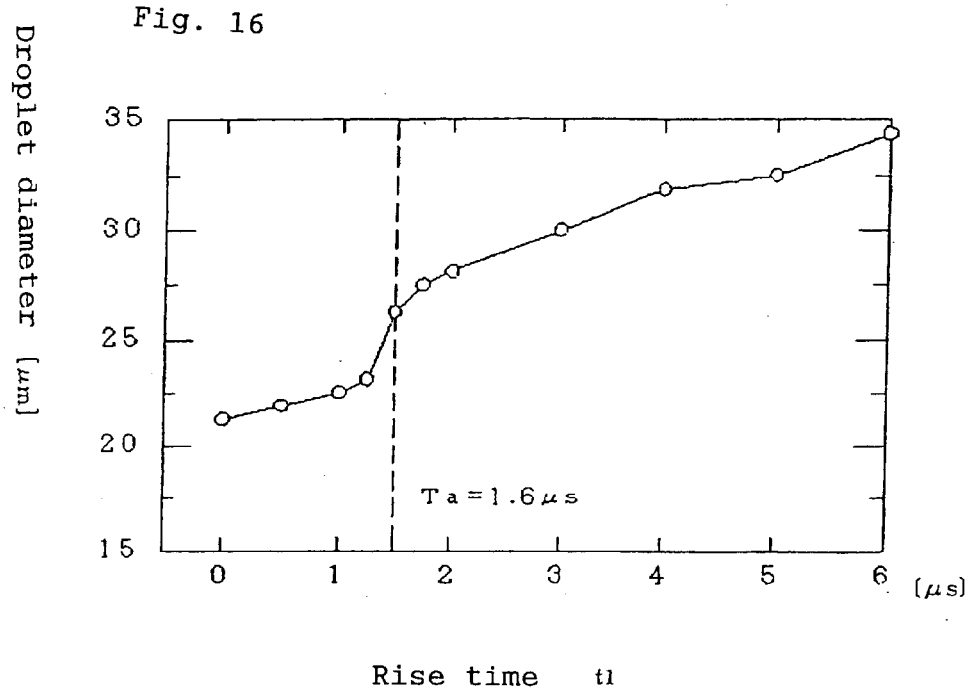
FIG. 16 is a graph showing the relationship between the pressure rise time and the droplet diameter.

FIG. 16 shows the results of observing changes in the droplet diameter as rise time t1 was varied, where fall time t2 was set such that t2=t1, and time t3 was set such that t3=1 μs when t1≦1 μs and t3~t1 when t1>1 μs. Applied voltages V1 and V2 were adjusted with respect to respective t1 such that the drop velocity was 6 m/s.

In FIG. 16, there can be seen a sharp change in droplet diameter at around t1=Ta where there is obviously a change in the ejection mechanism. In other words, while in the region where t1>Ta the ejection occurs due to the ink meniscus vibration with inherent period Tc, in the region where t1≦Ta, the ejection occurs due to the ink meniscus vibration with inherent period Ta. As will be seen from FIG. 16, the droplet diameter can be greatly reduced by using the driving method according to the present invention as compared with the conventional one.

Figure 17:
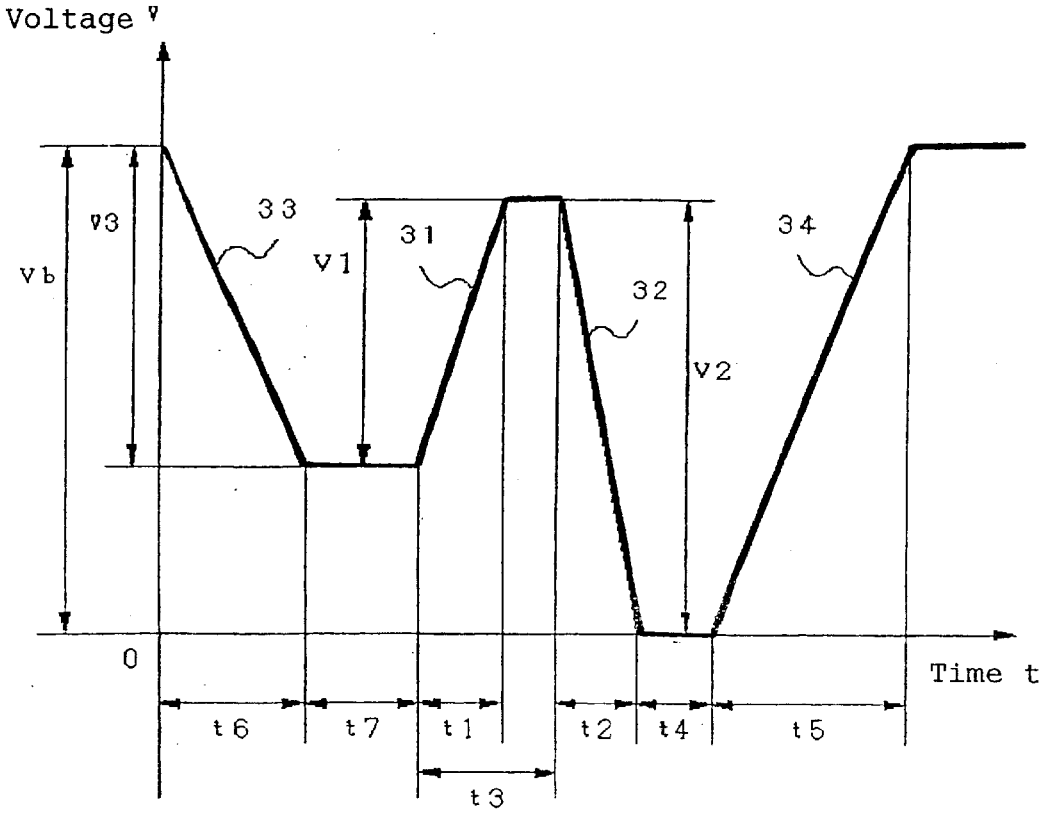
FIG. 17 is another exemplary chart of the driving waveform to be used in the driving method for the inkjet recording head according to an embodiment of the invention.

FIG. 17 shows an example of the driving waveform used for the ejection of a minute drop with a droplet diameter 15 μm or less in the above-mentioned inkjet recording head. The driving waveform of FIG. 17 includes a voltage fall 33 for meniscus control prior to a voltage rise 31. Thus, the driving waveform of FIG. 17 uses a driving method combining the ejection mechanism based on the inherent vibration of the piezoelectric actuator per se with the meniscus control system. Accordingly, it is possible to eject an ink droplet with an even smaller droplet diameter than in the case of using the driving waveform of FIG. 14.

The driving waveform of FIG. 17 includes a first drop portion 33 having a fall time (t6=3 μs) which is larger than inherent period Ta and smaller than inherent period Tc for dropping from an initial voltage Vb (40 volts) to V3 (18 volts). The first drop portion 33 occurs a t7 time (4 μs) earlier than a first voltage rise 31 which raises the voltage by V1. Such driving waveform makes it possible to combine the driving technique based on the inherent vibration of the piezoelectric actuator per se with the meniscus control technique.

Specifically, the first drop portion 33 has a fall time t6 (3 μs) which is larger than inherent period Ta and smaller than inherent period Tc and expands the pressure chamber. The first rise portion 31 has a voltage rise V1 for contracting the pressure chamber and has a shorter rise time t1 (0.5 μs) than inherent period Ta. The second drop portion 32 starts a t3 time (1 μs) after the start of the first rise portion 31, has a fall time t2 (0.5 μs) and expands the pressure chamber with a voltage change amount of V2 (36 volts) to bring the voltage to zero. The second rise portion 34 restores the voltage from zero back to initial voltage Vb and has a rise time (30 μs).

Figure 18:
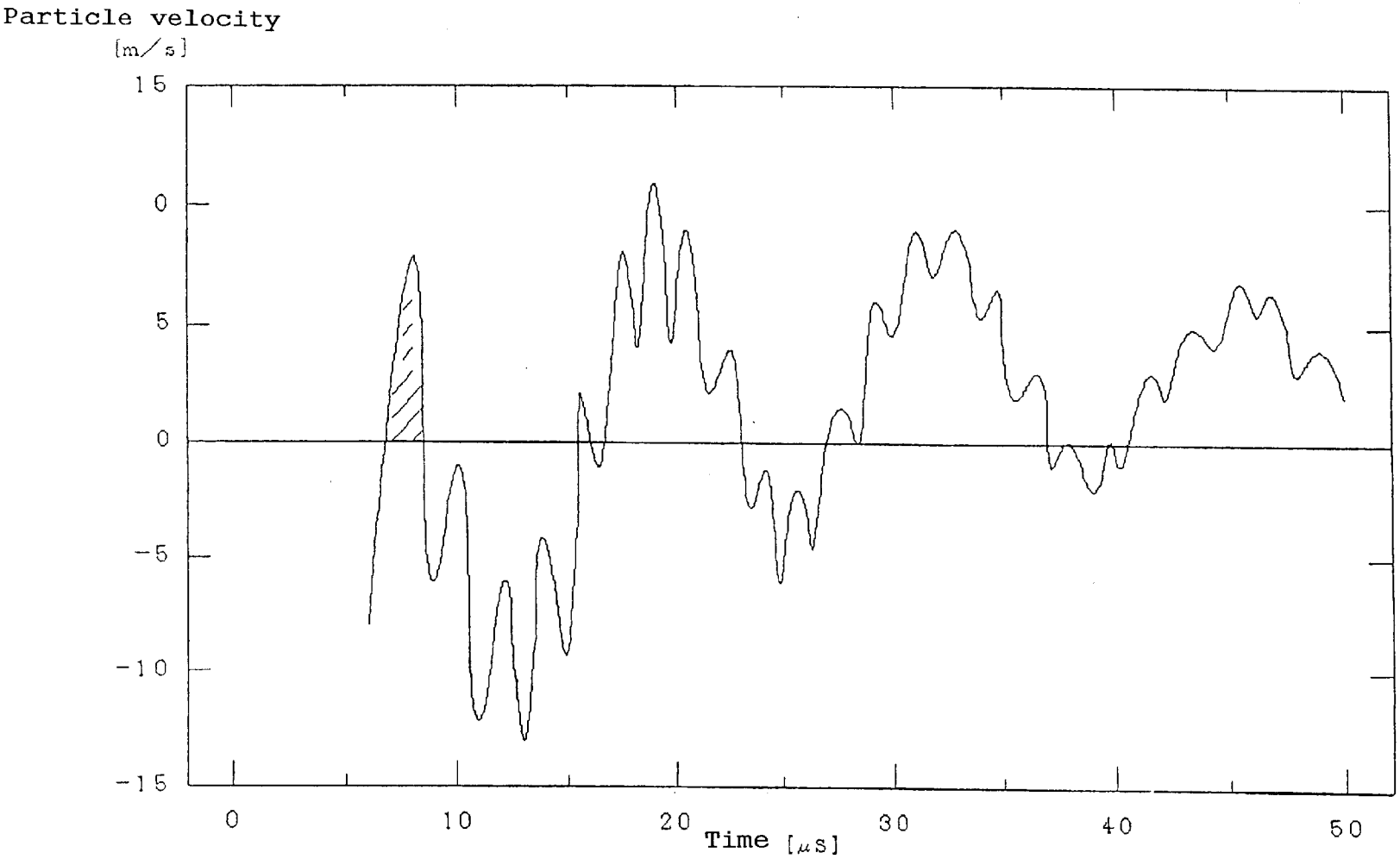
FIG. 18 is a graph showing the drop velocity along with time in the case of the driving voltage of FIG. 17.

FIG. 18 shows the results of observation of the movement of the ink meniscus by a laser Doppler meter when the driving waveform of FIG. 17 was applied. During the observation, the applied voltage was set low at 1/15, and the results of FIG. 18 indicate values obtained by multiplying the actually measured particle velocity by a factor of 15.

As shown in FIG. 18, when the driving waveform of FIG. 17 is applied to the piezoelectric actuator, initially a negative particle velocity is generated by the voltage fall 33, by which the ink meniscus is drawn into the pressure chamber, resulting in an concave ink meniscus. When a first voltage change process 31 is applied, v3>0 and the ink meniscus is displaced towards the outside of the nozzle. Since the previous ink meniscus was concave, a thin liquid column is formed at the center of the nozzle. According to the result of observation of the state of drop ejection (strobe observation), the thus formed liquid column had a thickness of about 15 μm (about one half the nozzle diameter).

After the formation of the liquid column, the second rise portion 32 is applied at a timing of Ta/2≦t3≦Ta, whereby the pressure chamber quickly contracts and returns to v3=0 at a very early period. As a result, the area of the shaded portion of FIG. 18 becomes very small and results in a waveform which is advantageous to the ejection of a minute drop.

When an ejection experiment was conducted by using the driving waveform of FIG. 17, it was observed that an ink droplet with a droplet diameter of 14 μm was ejected at a drop velocity of 6 m/s. The reason that the droplet diameter decreased further than when the driving waveform of FIG. 14 was used is that the meniscus control technique was used in combination. That is, it can be assumed that the use of the meniscus control resulted in an effect equivalent to the reduction of the nozzle diameter. When the experiment was conducted by using, for comparison, a driving waveform where t1=t2=t3=2 μs>Ta as in the conventional driving waveform, the minimum diameter of the minute drop that could be ejected was 21 μm.

The purpose of setting the driving waveform of FIG. 17 set such that Ta<t6≦Tc is to effect a stable ink meniscus shape control. If the setting is such that t6≦Ta, there will occur the vibration of inherent period Ta even during the time interval of t<t6+t7, causing such problems as a difficulty in accurately controlling the ink meniscus shape or an occurrence of unwanted ejection. Similarly, if the setting is such that t6>Tc, the change of particle velocity v3 during the time interval t≦t6+t7 will be complicated, thereby also making it difficult to accurately control the ink meniscus shape. In particular, a large property variability tends to occur in the case of a multi-nozzle head.

Accordingly, it is desirable that time t6 is within the range Ta<t6≦Tc, in which case there occurs no vibration of inherent period Ta during the time interval t≦t6+t7, thus making it possible to control the ink meniscus shape in a stable manner. However, in the case of a single-nozzle head or other heads where a high uniformity can be ensured between the nozzles, the waveform may be set such that t6<ta or t6>Tc.

Figure 20:
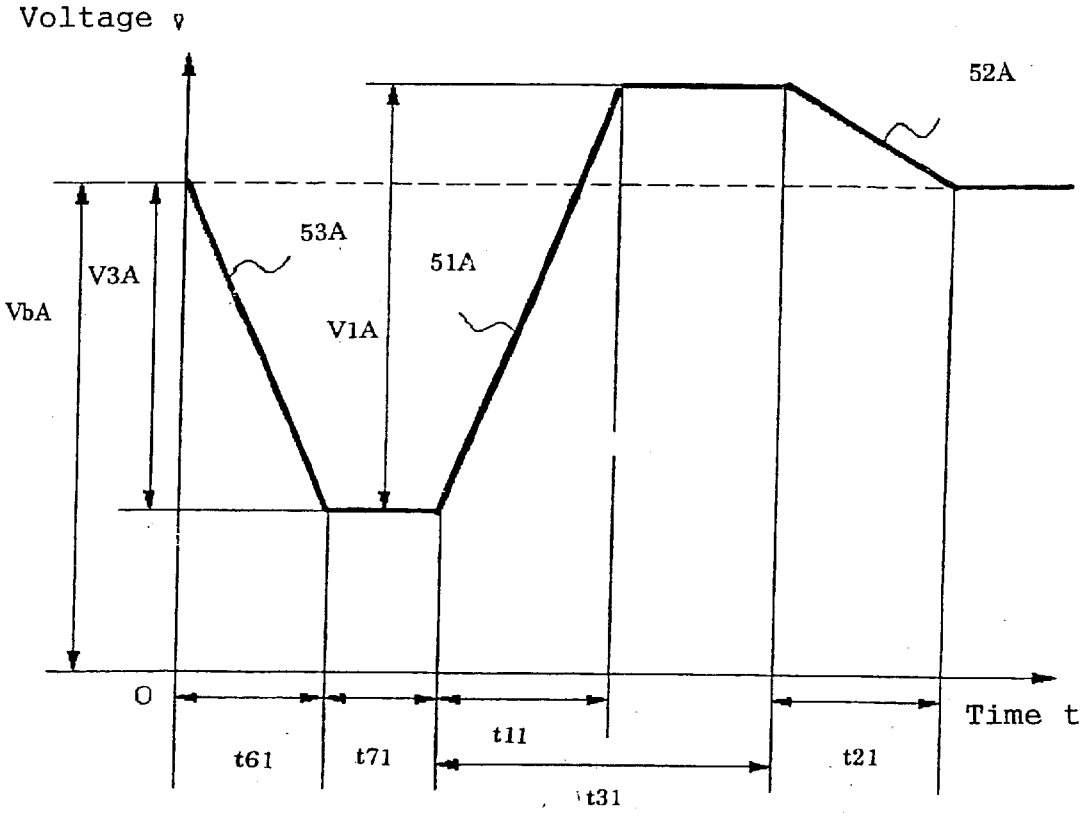
FIG. 20 is a chart showing another driving waveform for use in the method of driving the inkjet recording head in accordance with another embodiment of the invention for producing a middle-size ink droplet in accordance with another embodiment of the invention.
Figure 21:
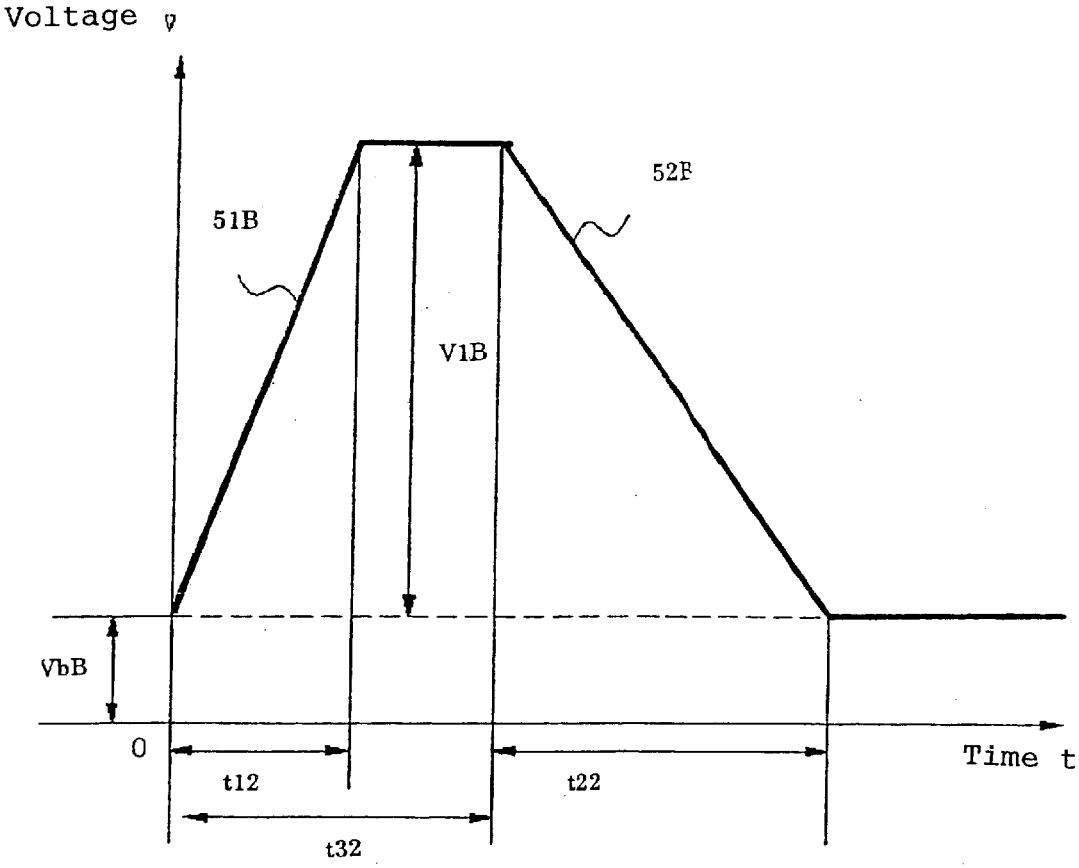
FIG. 21 is a chart showing a driving waveform for use in the method of driving the inkjet recording head in accordance with another embodiment of the invention for producing a large ink droplet in accordance with another embodiment of the invention.

FIGS. 19–21 show driving waveforms used for the modulation of the ejected ink droplet into three sizes of small, middle and large drop in the above-mentioned inkjet recording head. The small-drop waveform of FIG. 19 is identical in shape to the driving waveform of FIG. 17. The middle- and large-drop waveforms shown in FIGS. 20 and 21, respectively, have a rise time (t11, t12) set larger than inherent period Ta of the circuit and for use with a driving method which does not involve the excitation of the inherent vibration of the piezoelectric actuator.

The middle-drop driving waveform of FIG. 20 has a first drop portion 53A having a fall time t61 (3 μs) for the drop from the initial voltage to a voltage fall amount V3A, whereby the ink meniscus is made to assume a concave shape immediately before the ejection. After a first retaining time t71 (4 μs), the pressure chamber is compressed by a voltage rise 51A with a rise time t11 (3 μs) which is larger than inherent period Ta, followed by a second retaining time 13 μs (t31–t11) which is larger than inherent period Ta. Thereafter the waveform is returned back to initial voltage Vb (40V) by a second drop portion 52A with a fall time t21 (30 μs).

In the case of the large-drop driving waveform of FIG. 21, the pressure chamber is compressed by a voltage rise 51B having a large rise time t12 (10 μs) following the initial voltage, and then the voltage slowly returns back to initial voltage by way of a voltage fall 52B having a fall time t22 (30 μs), thereby expanding the volume of the pressure chamber. The driving waveform of FIG. 21 does not involve the drawing of the ink meniscus immediately prior to the ejection.

Referring to FIG. 13, the driving waveforms for the small-, middle- and large-drops, respectively, were generated by individual waveform generating circuits (131, 131A, 131B). By switching the waveforms to be applied to the piezoelectric actuator 134 based on the image data, a gray-scale recording was performed.

With the use of the driving waveforms of FIGS. 19–21, it was possible to eject a small-drop with a droplet diameter 14 μm at a drop velocity 6 m/s, a middle-drop with a droplet diameter 28 μm at a drop velocity 6.2 m/s and a large-drop with a droplet diameter 41 μm at a drop velocity 7 m/s, in each case with a driving frequency of 10 kHz. Thus it was possible to realize a wider drop-diameter modulating range of 14–41 μm than in the prior art while maintaining a high driving frequency.

It should be noted that the driving waveforms for the large- and middle-drops are not limited to the waveforms illustrated in the above embodiments and may employ other waveform shapes. For example, in the case of the large-drop driving waveform as well, the ejection stability can be improved by incorporating a voltage change process for making the shape of the ink meniscus slightly concave immediately before the ejection.

Also, while in the above embodiments the number of levels of drop-diameter modulation was three consisting of large, middle and small, the number of the drop-diameter levels may be more or less than 3 and still the present invention can be implemented.

Further, as mentioned above, by using the ejection principle based on the inherent vibration of the piezoelectric actuator according to the present invention for the ejection of a minute drop in the inkjet recording head performing the drop-diameter modulation, and by using the pressure wave under the control of acoustic capacity c1 of the pressure chamber for the ejection of a larger-diameter drop as according to the conventional inkjet recording head, a very wide drop-diameter modulation range can be obtained, thereby making it possible to realize both high-quality recording and high-speed recording at the same time.

Although the invention was described above by way of preferred embodiments, those embodiments should not be taken as limiting the present invention. For example, while in the above embodiments t1<t3 and there was the voltage retaining portion (flat portion) between the first and second voltage change processes, it may be that t1=t3, i.e., the driving waveform may have no constant voltage portion.

Figure 24:
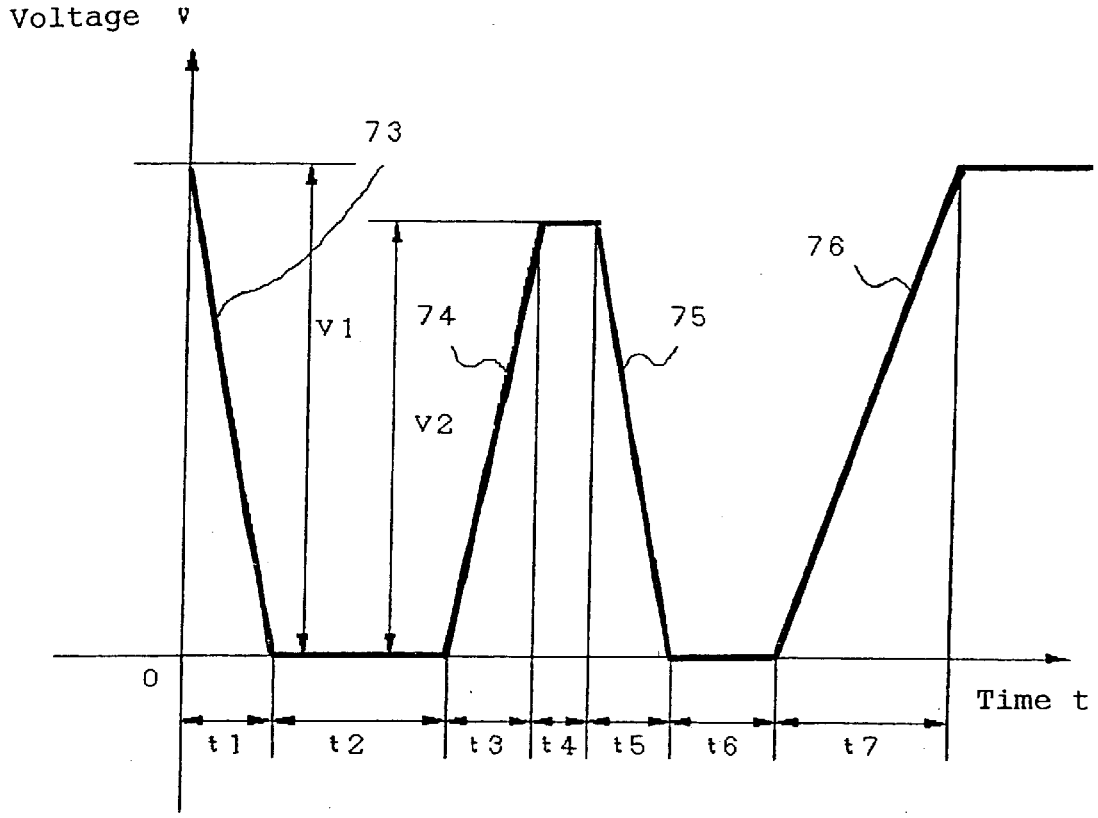
FIG. 24 is another chart showing a driving waveform for enabling the ejection of a smaller droplet.
Figure 25:
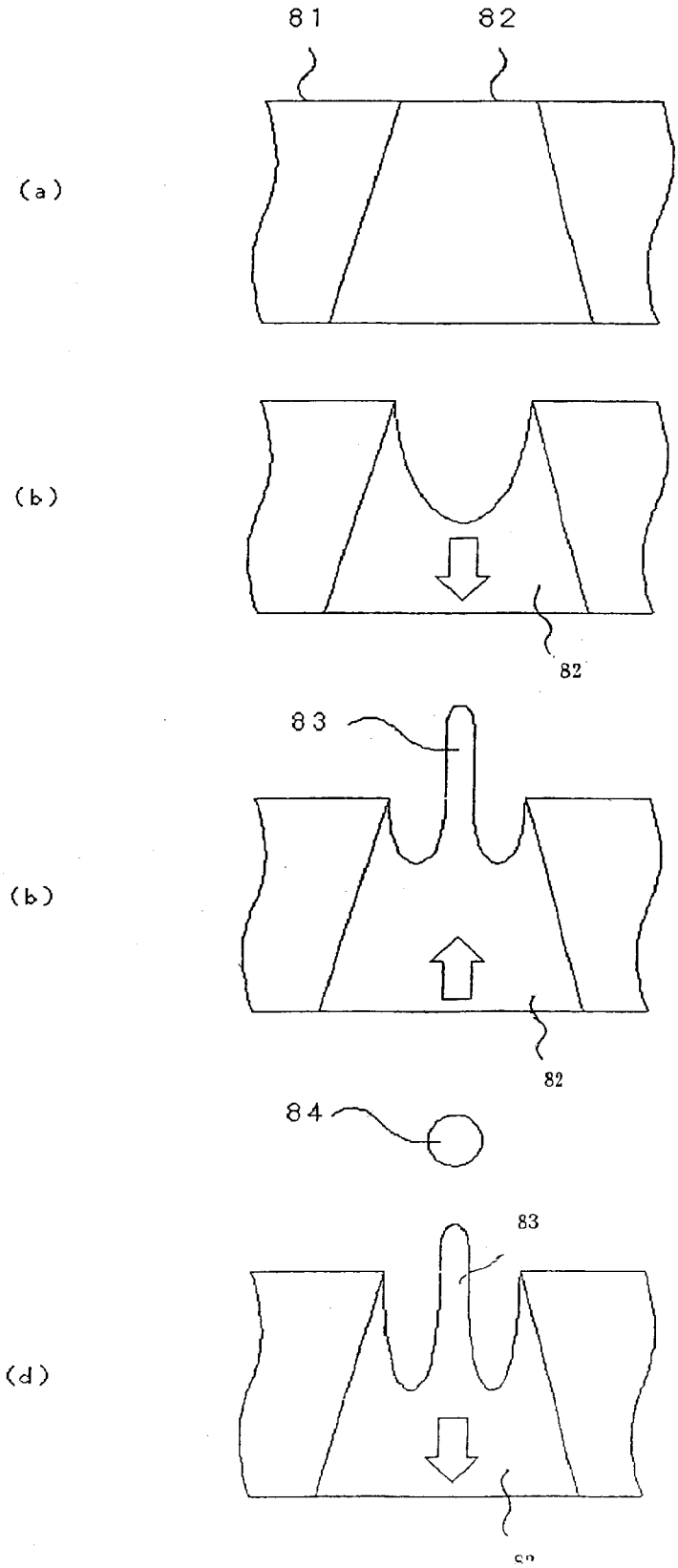
FIGS. 25(*a*) to (*d*) illustrate the movement of the ink meniscus at the nozzle opening portion upon the application of the driving waveform of FIG. 23.
Figure 26:
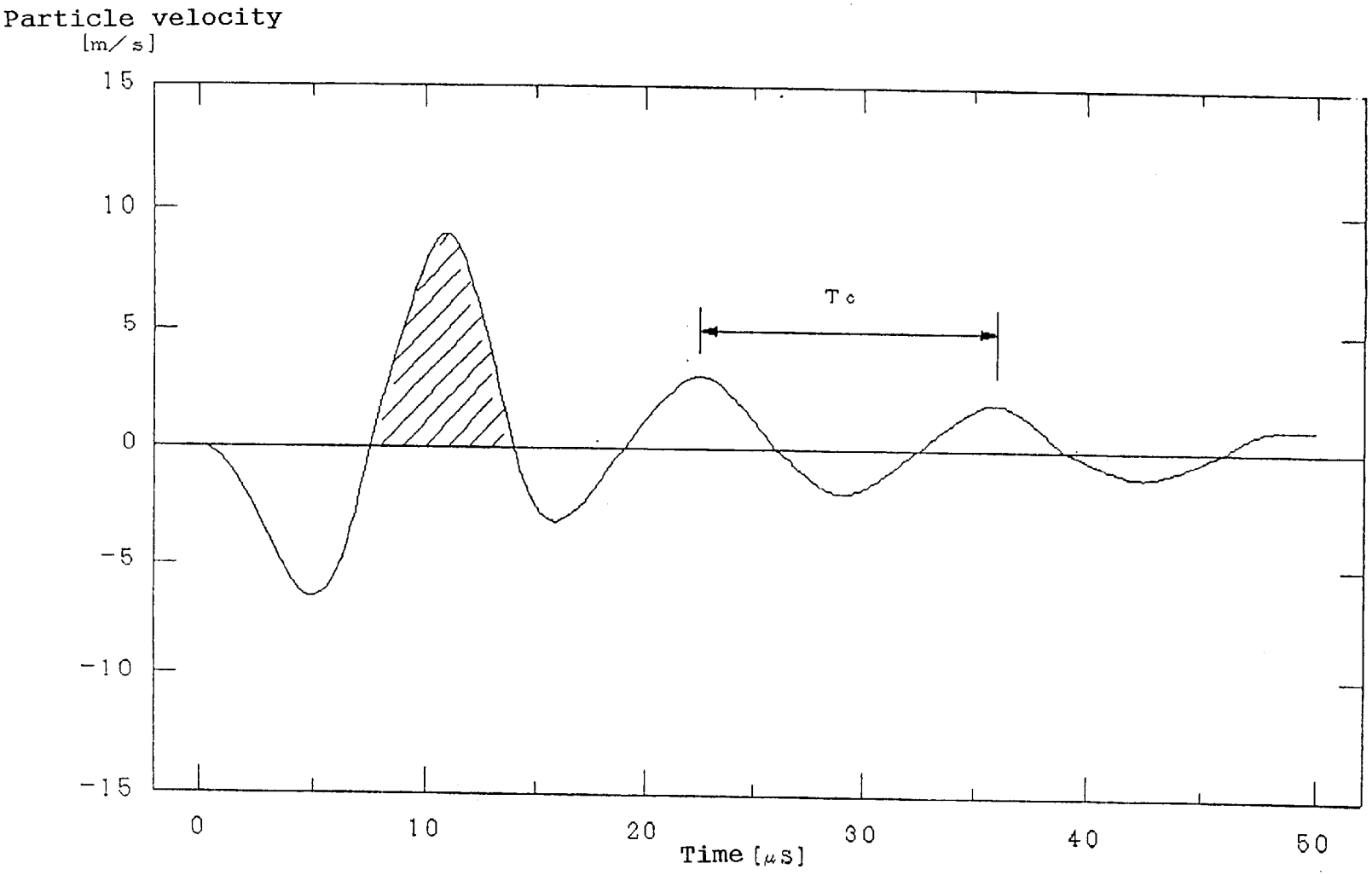
FIG. 26 shows the result of observation of velocity changes in the ink meniscus.
Figure 27:
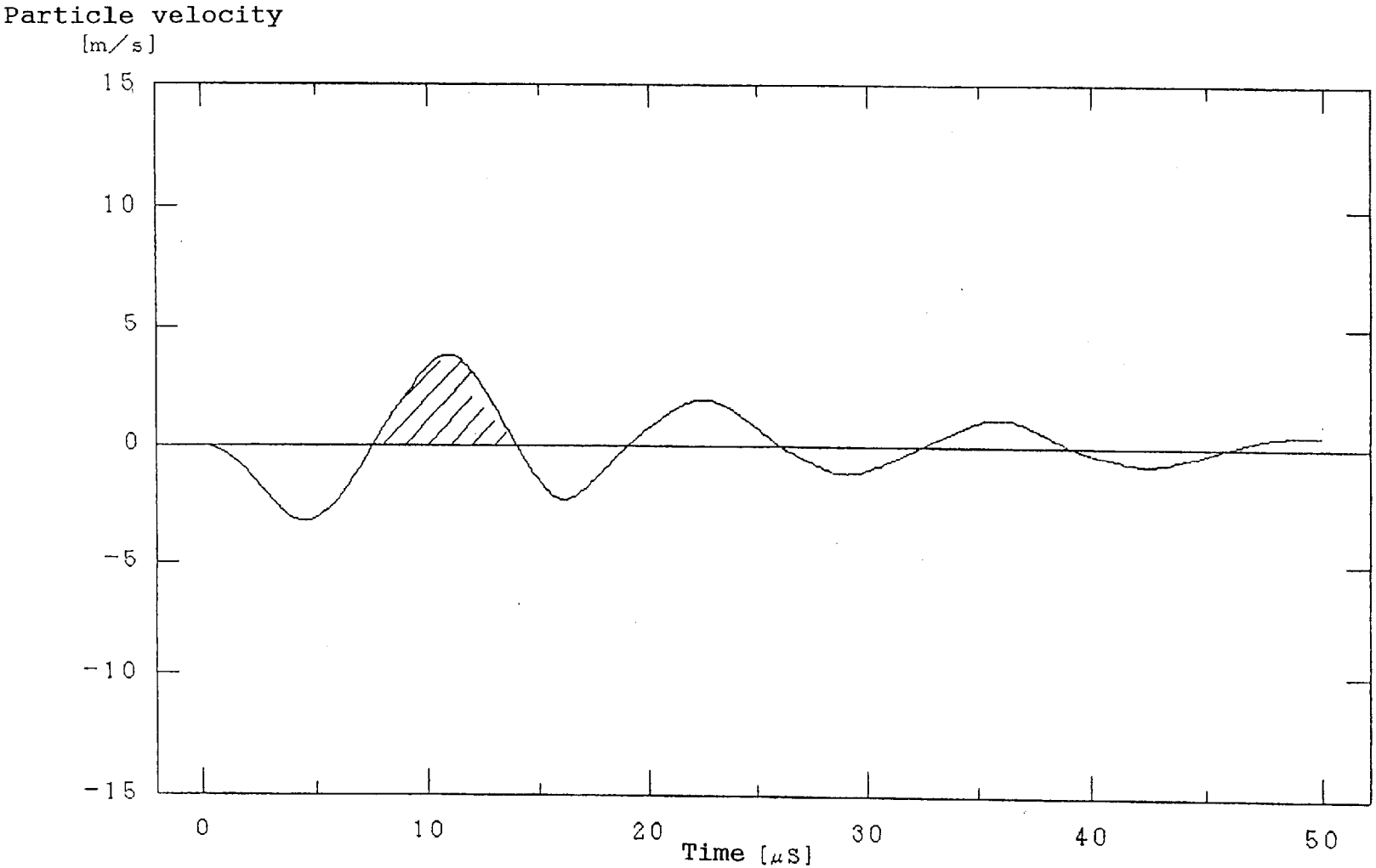
FIG. 27 is another graph showing the drop velocity at the nozzle portion against time.
Figure 28:
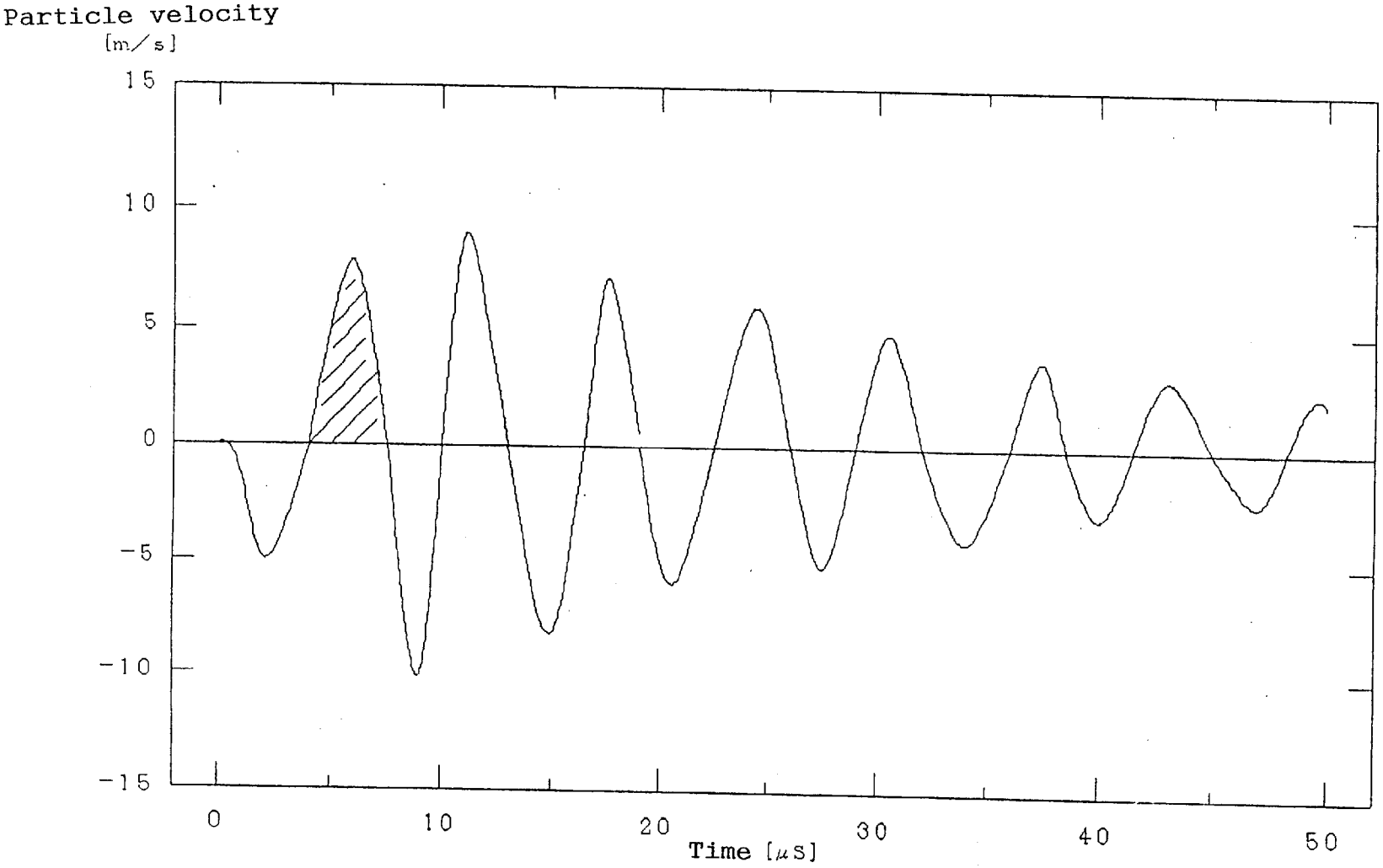
FIG. 28 is another a graph showing the drop velocity at the nozzle portion against time.

Furthermore, while the driving waveform in the embodiments did not involve a compulsory suppression of reverberations after the ink droplet ejection, such a reverberation suppressing process as shown in FIG. 24 may be incorporated.

In the above embodiments, inherent period Ta of the piezoelectric actuator per se (actuator unit) was set at 1.6 μs, but it may be set at other values. It is desirable, however, to set inherent period TA at 5 μs or less if a minute ink droplet with a droplet diameter on the order of 15 μm is to be ejected.

Furthermore, while bias voltage (initial voltage) Vb was set such that the application voltage to the piezoelectric actuator was positive at all times in the embodiments, bias voltage Vb may be set at other voltages, e.g., zero V, provided a negative voltage can be applied to the piezoelectric actuator without any problems.

While in the embodiments, the piezoelectric actuator included a longitudinal vibration-mode piezoelectric actuator with a piezoelectric constant d33, other types of actuators may be used, such as a longitudinal vibration-mode actuator with a piezoelectric constant d31. In the embodiments, the stacked-type piezoelectric actuator was used, but the same advantages can be obtained by using a single plate-type piezoelectric actuator. If inherent period Ta can be set small enough, it is also possible to use a deflection vibration-mode piezoelectric actuator.

While the embodiments employed such a Kaiser-type inkjet recording head as shown in FIG. 22, the present invention can be applied in other inkjet recording heads with different structures, such as a recording head having a groove provided in the piezoelectric actuator as the pressure chamber. Furthermore, the invention can be applied in such inkjet recording heads that employ other types of electro-mechanical transducers than the piezoelectric electric actuator, such as actuators utilizing electrostatic force or magnetic force.

Thus, in accordance with the method of driving the inkjet recording head and the inkjet recording apparatus using the method according to the present invention, it is possible to eject a micro drop with a droplet diameter on the order of 15 μm, so that the image quality can be greatly improved.

In accordance with a preferred embodiment of the invention, the ejection of such micro drop is possible without setting the volume (W1) of the pressure chamber small, whereby the ejection can be made at a high driving frequency without causing an increase in the refill time.

In accordance with a further preferred embodiment of the invention, the ejection principle taking advantage of the inherent vibration of the piezoelectric actuator in accordance with the invention can be used in combination with the conventional ejection principle that takes advantage of the pressure wave governed by the acoustic capacitance (c1) of the pressure chamber, so that there can be obtained a wide drop-diameter modulation range, making it possible to provide high-image quality and high-recording speed at the same time.

What is claimed is:

1. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer, wherein the inherent vibration period Ta is 5 μs or less; and changing a voltage of said first waveform portion by an amount that is smaller than a voltage change amount of said second waveform portion.

2. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer, wherein the inherent vibration period Ta is 5 $\mu$s or less;

changing a voltage of said first waveform portion by an amount that is smaller than a voltage change amount of said second waveform portion; and generating a third waveform portion before said first waveform portion, said third waveform portion drawing an ink meniscus at said ink nozzle towards said pressure chamber.

3. The method of driving an inkjet recording head according to claim 2, wherein said third waveform portion expands the volume of said pressure chamber.

4. The method of driving an inkjet recording head according to claim 1, further comprising generating a third waveform portion before said first waveform portion, said third waveform portion drawing an ink meniscus at said ink nozzle towards said pressure chamber.

5. The method of driving an inkjet recording head according to claim 4, wherein said third waveform portion expands the volume of said pressure chamber.

6. The method of driving an inkjet recording head according to claim 1, further comprising generating a second driving waveform, said second driving waveform including a third waveform portion having a third time length for contracting the volume of said pressure chamber and a third waveform portion having a fourth time length for expanding said pressure chamber and a third waveform portion having a fourth time length for expanding said pressure chamber; and setting said third and fourth time lengths to a length that is longer than the inherent period Ta of said electro-mechanical transducer.

7. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer; and generating a third waveform portion before said first waveform portion, said third waveform portion drawing an ink meniscus at said ink nozzle towards said pressure chamber, wherein said third waveform portion expands the volume of said pressure chamber and wherein the pressure wave within said pressure chamber has an inherent vibration period Tc defined by an acoustic capacity of said pressure chamber, and wherein a time length t6 of said third waveform portion satisfies a relationship $Ta \leqq t6 \leqq Tc$ between said inherent periods Ta and Tc.

8. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber; and setting said first and second time lengths t1 and t2 to a length that is equal to or shorter than the inherent vibration period Ta of said electro-mechanical transducer, wherein the inherent vibration period Ta of said electro-mechanical transducer is 5 $\mu$s or less.

9. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method characterized in that:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer;

changing a voltage of said first waveform portion by an amount that is smaller than a voltage change amount of said second waveform portion; and generating a second driving waveform, said second driving waveform including a third waveform portion having a third time length for contracting the volume of said pressure chamber and a fourth waveform portion having a fourth time length for expanding said pressure chamber; and setting said third and fourth time lengths to a length that is longer than the inherent period Ta of said electro-mechanical transducer, wherein the inherent vibration period Ta is 5 $\mu$s or less.

10. An inkjet recording apparatus comprising:

an inkjet recording head including:

a pressure chamber filled with a liquid ink, said pressure chamber having an ink supply port for supplying the liquid ink and an ink nozzle for ejecting said ink in a form of at least one ink droplet; and an electro-mechanical transducer disposed such that a pressure wave is generated in said pressure chamber by applying a driving voltage in order to eject the ink droplet via said ink nozzle, said transducer having an inherent vibration period Ta; and a driving waveform generating circuit for generating one or more driving waveforms for the driving voltage to be applied to said electro-mechanical transducer that vibrates in a longitudinal vibration mode, said driving waveform including:

a first driving waveform including consecutively a first waveform portion having a first time length for contracting a volume of said pressure chamber and a second waveform portion having a second time length for expanding the volume of said pressure chamber, said first and second time lengths being set to a length that is equal to or shorter than an inherent vibration period Ta of said electro-mechanical transducer, a voltage of said first waveform portion being changed by an amount that is smaller than a voltage change amount of said second waveform portion; and a second driving waveform including consecutively a third waveform portion having a third time length for contracting the volume of said pressure chamber and a fourth waveform portion having a fourth time length for expanding the volume of said pressure chamber, said third and fourth time lengths being longer than the inherent vibration period Ta of said electro-mechanical transducer, wherein the inherent vibration period Ta is 5 $\mu$s or less.

11. The inkjet recording apparatus according to claim 10, wherein said electro-mechanical transducer includes a piezoelectric vibrator.

12. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer, wherein an interval t3 between a start time of said first waveform portion and the start time of said second waveform portion satisfies $Ta/2. \leqq t3 \leqq Ta$, and wherein a voltage change amount of said first waveform portion is smaller than a voltage change amount of said second waveform portion and, wherein the inherent vibration period Ta is 5 $\mu$s or less.

13. The method of driving an inkjet recording head according to claim 12, further comprising generating a third waveform portion before said first waveform portion, said third waveform portion drawing an ink meniscus at said ink nozzle towards said pressure chamber.

14. The method of driving an inkjet recording head according to claim 13, wherein said third waveform portion expands the volume of said pressure chamber.

15. The method of driving an inkjet recording head according to claim 12, further comprising generating a second driving waveform, said second driving waveform including a third waveform portion having a third time length for contracting the volume of said pressure chamber and a third waveform portion having a fourth time length for expanding said pressure chamber and a third waveform portion having a fourth time length for expanding said pressure chamber; and setting said third and fourth time lengths to a length that is longer than the inherent period Ta of said electro-mechanical transducer.

16. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer, wherein an interval t3 between a start time of said first waveform portion and the start time of said second waveform portion satisfies $Ta/2 \leqq t3 \leqq Ta$, and wherein a voltage change amount of said first waveform portion is smaller than a voltage change amount of said second waveform portion, wherein the inherent vibration period Ta is 5 $\mu$s or less; and generating a third waveform portion before said first waveform portion, said third waveform portion drawing an ink meniscus at said ink nozzle towards said pressure chamber.

17. The method of driving an inkjet recording head according to claim 16, wherein said third waveform portion expands the volume of said pressure chamber.

18. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer, wherein an interval t3 between a start time of said first waveform portion and the start time of said second waveform portion satisfies $Ta/2 \leqq t3 \leqq Ta$; and generating a third waveform portion before said first waveform portion, said third waveform portion drawing an ink meniscus at said ink nozzle towards said pressure chamber, wherein said third waveform portion expands the volume of said pressure chamber, and wherein said pressure wave within said pressure chamber has an inherent vibration period Tc defined by an acoustic capacity of said pressure chamber, and wherein a time length t6 of said third waveform portion satisfies a relationship $Ta \leqq t6 \leqq Tc$ between said inherent periods Ta and Tc.

19. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer;

changing a voltage of said first waveform portion by an amount that is smaller than a voltage change amount of said second waveform portion; and generating a third waveform portion before said first waveform portion, said third waveform portion drawing an ink meniscus at said ink nozzle towards said pressure chamber, wherein said third waveform portion expands the volume of said pressure chamber, and wherein the pressure wave within said pressure chamber has an inherent vibration period Tc defined by an acoustic capacity of said pressure chamber, and wherein a time length t6 of said third waveform portion satisfies a relationship $Ta \leqq t6 \leqq Tc$ between said inherent periods Ta and Tc.

20. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer, wherein an interval t3 between a start time of said first waveform portion and the start time of said second waveform portion satisfies $Ta/2 \leqq t3 \leqq Ta$, and wherein a voltage change amount of said first waveform portion is smaller than a voltage change amount of said second waveform portion;

generating a third waveform portion before said first waveform portion, said third waveform portion drawing an ink meniscus at said ink nozzle towards said pressure chamber; and wherein said third waveform portion expands the volume of said pressure chamber, and wherein the pressure wave within said pressure chamber has an inherent vibration period Tc defined by an acoustic capacity of said pressure chamber, and wherein a time length t6 of said third waveform portion satisfies a relationship $Ta \leqq t6 \leqq Tc$ between said inherent periods Ta and Tc.

21. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer, wherein an interval t3 between a start time of said first waveform portion and the start time of said second waveform portion satisfies $Ta/2. \leqq t3 \leqq Ta$, and wherein the inherent vibration period Ta of said electro-mechanical transducer is 5 $\mu$s or less.

22. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer; and changing a voltage of said first waveform portion by an amount that is smaller than a voltage change amount of said second waveform portion; and wherein the inherent vibration period Ta of said electro-mechanical transducer is 5 $\mu$s or less.

23. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer, wherein an interval t3 between a start time of said first waveform portion and the start time of said second waveform portion satisfies $Ta/2 \leqq t3 \leqq Ta$, and wherein a voltage change amount of said first waveform portion is smaller than a voltage change amount of said second waveform portion; and wherein the inherent vibration period Ta of said electro-mechanical transducer is 5 $\mu$s or less.

24. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer; and generating a third waveform portion before said first waveform portion, said third waveform portion drawing an ink meniscus at said ink nozzle towards said pressure chamber; and wherein the inherent vibration period Ta of said electro-mechanical transducer is 5 $\mu$s or less.

25. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer, wherein an interval t3 between a start time of said first waveform portion and the start time of said second waveform portion satisfies $Ta/2 \leqq t3 \leqq Ta$; and generating a third waveform portion before said first waveform portion, said third waveform portion drawing an ink meniscus at said ink nozzle towards said pressure chamber; and wherein the inherent vibration period Ta of said electro-mechanical transducer is 5 $\mu$s or less.

26. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer; and changing a voltage of said first waveform portion by an amount that is smaller than a voltage change amount of said second waveform portion; and generating a third waveform portion before said first waveform portion, said third waveform portion drawing an ink meniscus at said ink nozzle towards said pressure chamber; and wherein the inherent vibration period Ta of said electro-mechanical transducer is 5 $\mu$s or less.

27. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer, wherein an interval t3 between a start time of said first waveform portion and the start time of said second waveform portion satisfies $Ta/2 \leqq t3 \leqq Ta$, and wherein a voltage change amount of said first waveform portion is smaller than a voltage change amount of said second waveform portion; and generating a third waveform portion before said first waveform portion, said third waveform portion drawing an ink meniscus at said ink nozzle towards said pressure chamber; and wherein the inherent vibration period Ta of said electro-mechanical transducer is 5 μs or less.

28. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer; and generating a third waveform portion before said first waveform portion, said third waveform portion drawing an ink meniscus at said ink nozzle towards said pressure chamber;

wherein said third waveform portion expands the volume of said pressure chamber and wherein the inherent vibration period Ta of said electro-mechanical transducer is 5 μs or less.

29. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer, wherein an interval t3 between a start time of said first waveform portion and the start time of said second waveform portion satisfies $Ta/2 \leqq t3 \leqq Ta$; and generating a third waveform portion before said first waveform portion, said third waveform portion drawing an ink meniscus at said ink nozzle towards said pressure chamber; and wherein said third waveform portion expands the volume of said pressure chamber, and wherein the inherent vibration period Ta of said electro-mechanical transducer is 5 μs or less.

30. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer; and changing a voltage of said first waveform portion by an amount that is smaller than a voltage change amount of said second waveform portion; and generating a third waveform portion before said first waveform portion, said third waveform portion drawing an ink meniscus at said ink nozzle towards said pressure chamber; and wherein said third waveform portion expands the volume of said pressure chamber, and the inherent vibration period Ta of said electro-mechanical transducer is 5 μs or less.

31. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer, wherein an interval t3 between a start time of said first waveform portion and the start time of said second waveform portion satisfies $Ta/2 \leqq t3 \leqq Ta$, and wherein a voltage change amount of said first waveform portion is smaller than a voltage change amount of said second waveform portion; and generating a third waveform portion before said first waveform portion, said third waveform portion drawing an ink meniscus at said ink nozzle towards said pressure chamber; and wherein said third waveform portion expands the volume of said pressure chamber and the inherent vibration period Ta of said electro-mechanical transducer is 5 μs or less.

32. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer; and generating a third waveform portion before said first waveform portion, said third waveform portion drawing an ink meniscus at said ink nozzle towards said pressure chamber; and wherein said third waveform portion expands the volume of said pressure chamber, wherein the pressure wave within said pressure chamber has an inherent vibration period Tc defined by an acoustic capacity of said pressure chamber, and wherein a time length t6 of said third waveform portion satisfies a relationship $Ta \leqq t6 \leqq Tc$ between said inherent periods Ta and Tc, and wherein the inherent vibration period Ta of said electro-mechanical transducer is 5 $\mu$s or less.

33. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer, wherein an interval t3 between a start time of said first waveform portion and the start time of said second waveform portion satisfies $Ta/2 \leqq t3 \leqq Ta$; and generating a third waveform portion before said first waveform portion, said third waveform portion drawing an ink meniscus at said ink nozzle towards said pressure chamber; and wherein said third waveform portion expands the volume of said pressure chamber, wherein said pressure wave within said pressure chamber has an inherent vibration period Tc defined by an acoustic capacity of said pressure chamber, wherein a time length t6 of said third waveform portion satisfies a relationship $Ta \leqq t6 \leqq Tc$ between said inherent periods Ta and Tc, and wherein the inherent vibration period Ta of said electro-mechanical transducer is 5 $\mu$s or less.

34. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer; and changing a voltage of said first waveform portion by an amount that is smaller than a voltage change amount of said second waveform portion; and generating a third waveform portion before said first waveform portion, said third waveform portion drawing an ink meniscus at said ink nozzle towards said pressure chamber; and wherein said third waveform portion expands the volume of said pressure chamber, wherein the pressure wave within said pressure chamber has an inherent vibration period Tc defined by an acoustic capacity of said pressure chamber, wherein a time length t6 of said third waveform portion satisfies a relationship $Ta \leqq t6 \leqq Tc$ between said inherent periods Ta and Tc, and wherein the inherent vibration period Ta of said electro-mechanical transducer is 5 $\mu$s or less.

35. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer, wherein an interval t3 between a start time of said first waveform portion and the start time of said second waveform portion satisfies $Ta/2 \leqq t3 \leqq Ta$, and wherein a voltage change amount of said first waveform portion is smaller than a voltage change amount of said second waveform portion; and generating a third waveform portion before said first waveform portion, said third waveform portion drawing an ink meniscus at said ink nozzle towards said pressure chamber; and wherein said third waveform portion expands the volume of said pressure chamber, wherein the pressure wave within said pressure chamber has an inherent vibration period Tc defined by an acoustic capacity of said pressure chamber, wherein a time length t6 of said third waveform portion satisfies a relationship Ta≦t6≦Tc between said inherent periods Ta and Tc, and wherein the inherent vibration period Ta of said electro-mechanical transducer is 5 μs or less.

36. A method of driving an inkjet recording head having a pressure chamber filled with a liquid ink, said pressure chamber including an ink supply port for supplying the liquid ink and an ink nozzle for ejecting said ink in the form of at least one ink droplet, and an electro-mechanical transducer disposed such that a pressure wave is generated in said pressure chamber by applying a driving voltage in order to eject the ink droplet via said ink nozzle, said transducer having an inherent vibration period Ta in a longitudinal vibration mode, said method comprising:

generating a first driving voltage waveform, said first driving voltage waveform including consecutively a first waveform portion having a first time length t1 for contracting a volume of said pressure chamber and a second waveform portion having a second time length t2 for expanding the volume of said pressure chamber;

setting said first and second time lengths t1 and t2 to a length that is equal to or shorter than the inherent vibration period Ta of said electro-mechanical transducer, wherein an interval t3 between a start time of said first waveform portion and the start time of said second waveform portion satisfies Ta/2≦t3≦Ta;

changing a voltage of said first waveform portion by an amount that is smaller than a voltage change amount of said second waveform portion;

generating a second driving waveform, said second driving waveform including a third waveform portion having a third time length for contracting the volume of said pressure chamber and a third waveform portion having a fourth time length for expanding said pressure chamber and a third waveform portion having a fourth time length for expanding said pressure chamber; and setting said third and fourth time lengths to a length that is longer than the inherent period Ta of said electro-mechanical transducer, wherein the inherent vibration period Ta is 5 μs or less.

* * * * *